United States Patent [19]

Takahashi et al.

[11] Patent Number: 4,492,195

[45] Date of Patent: Jan. 8, 1985

[54] METHOD OF FEEDBACK CONTROLLING ENGINE IDLE SPEED

[75] Inventors: Toru Takahashi; Takashi Ueno, both of Yokosuka, Japan

[73] Assignee: Nissan Motor Company, Limited, Japan

[21] Appl. No.: 532,555

[22] Filed: Sep. 15, 1983

[30] Foreign Application Priority Data

Sep. 16, 1982 [JP] Japan ..... 57-159533

[51] Int. Cl.[3] ..... F02M 3/00; F02M 23/06

[52] U.S. Cl. ..... 123/339; 123/585; 123/589

[58] Field of Search ..... 123/339, 478, 480, 488, 123/585, 588, 589

[56] References Cited

U.S. PATENT DOCUMENTS 4,383,515 5/1983 Higashiyama et al. ..... 123/480
4,389,996 6/1983 Yaegashi et al. ..... 123/478

FOREIGN PATENT DOCUMENTS 56-14836 2/1981 Japan .

OTHER PUBLICATIONS

Powell et al., "Linear Quadratic Control Design for Nonlinear IC Engine Systems", Powerplant Dynamics, Sept. 7, 1981.

Morris et al., "Engine Idle Dynamics and Control", SAE Technical Paper Series, Passenger Car Meeting, Troy, Michigan, Jun. 7–10, 1982.

*Primary Examiner*—William A. Cuchlinski, Jr.
*Attorney, Agent, or Firm*—Lowe, King, Price & Becker

[57] ABSTRACT

Engine idle speed is feedback controlled on the basis of multivariable control method by using mathematical dynamic models to determine engine state variables. In the present invention, low-order (e.g. 4 order) dynamic models are adopted for facilitating calculations. The resulting control error is reduced or eliminated by several features as follows: the difference between the target idle speed and the current engine speed is integrated; an appropriate dynamic model is selected according to engine operating condition (coolant temp, $O_2$ sensor); an appropriate control gain is determined according to engine load condition (air conditioner); the initial integral value of speed difference and the initial state variables are determined according to the engine speed at which the throttle valve is fully closed and the engine speed at which control starts in table look-up method; the target engine idle speed is corrected according to engine conditions; feedforward control is additionally provided, etc.

19 Claims, 33 Drawing Figures

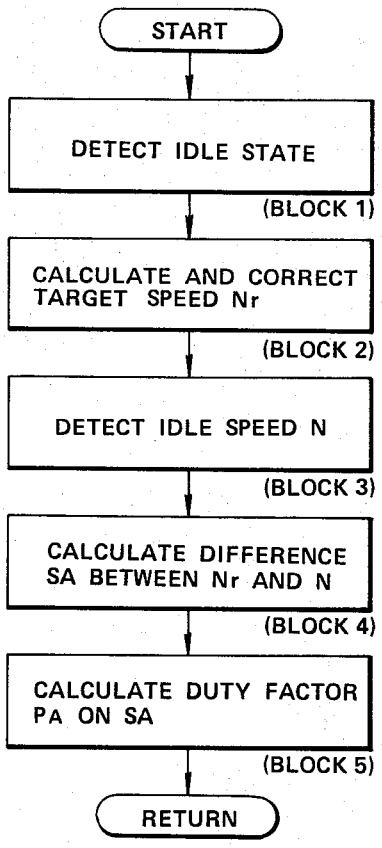
FIG.2
(PRIOR ART)
FIG.3
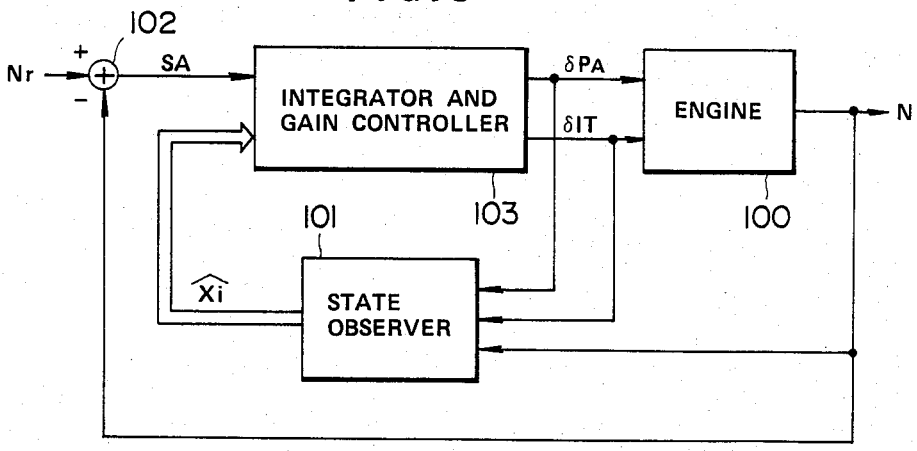

METHOD OF FEEDBACK CONTROLLING ENGINE IDLE SPEED

BACKGROUND OF THE INVENTION

1. Field of the Invention

The present invention relates generally to a method of feedback controlling idle speed of an internal combustion engine to a target speed, and more specifically to a method of feedback controlling engine idle speed on the basis of engine state variables estimated in accordance with mathematical dynamic models, in which an engine is managed as a dynamic system under the consideration of engine internal states and the engine dynamic behavior is estimated on the basis of mathematical dynamic models of state variables representative of engine internal states in order to determine engine idle speed controlling values. The above-mentioned state variable feedback control method is quite different from the conventional proportional, integral or differential feedback control method.

2. Description of the Prior Art

Various engine idle speed control systems for internal combustion engines are well known. In these systems, when the engine is determined to be idled in response to a signal outputted from a throttle valve idle switch, a neutral signal from a transmission neutral switch, a vehicle speed signal from a speed sensor, etc., a basic target engine idle speed is calculated according to coolant temperature detected by a coolant temperature sensor on the basis of table look-up method and then corrected to a final target engine idle speed under the consideration of the on-off state of an air conditioning system and the magnitude of battery voltage. Thereafter, the quantity of air bypassing the throttle value, for instance, is so adjusted by proportional or integral feedback control method that the difference in engine idle speed between the calculated and corrected target value and the actually detected value is minimized.

In the conventional engine idle speed control systems, however, there exists a problem in that the response speed of the control system is not sufficient, in particular, in the transient state where engine torque is disturbed due to neutral-to-drive shifting of the transmission lever or vice-versa, air conditioning system cycling or power steering pump connection or disconnection to or from the engine. This is because a proportional or integral feedback control system does not agree with the system in which a plurality of signals are feedbacked thereto.

A more detailed description of an example of a prior-art engine idle speed control system of this type will be made with reference to the attached drawings under

DETAILED DESCRIPTION OF THE PREFERRED EMBODIMENTS

Further, recently, some methods of feedback controlling engine idle speed have been proposed on the basis of mathematical dynamic models to determine state variables representative of engine dynamic behavior. However, in these methods, since the order of the mathematical dynamic models is relatively high, the resulting controlling calculations are complicated, thus giving rise to a complicated control system and a higher manufacturing cost.

SUMMARY OF THE INVENTION

With these problems in mind, therefore, it is the primary object of the present invention to provide a method of stably feedback controlling engine idle speed to a target value with a higher response speed, even in the transient state where the engine is shifted from driving to idling or vice versa or where the engine is subjected to torque disturbances due to connection or disconnection of load (air conditioning system or power steering pump) to or from the engine, while increasing the controllability of an idle speed by applying a number of engine controlling signals to a control system.

To achieve the above-mentioned object, the method of feedback controlling engine idle speed to a target value according to the present invention is based on stored mathematical dynamic models to determine engine state variables representative of engine dynamic behavior.

Further, in order to eliminate complicated calculations, low-order (e.g. four-order) mathematical dynamic models are adopted in the method according to the present invention, the resulting control error being reduced or eliminated by several features of the present invention as follows: (1) the difference between the target engine speed and the current engine speed is integrated; (2) an appropriate mathematical engine dynamic model is selected according to engine operating conditions (coolant temperature, lean-rich condition of exhaust gas); (3) an appropriate control gain is determined according to engine load conditions (air conditioning system, power steering pump); (4) an initial integral value of the integrated speed difference is determined on the basis of an engine idle speed detected when a throttle valve is fully closed and a predetermined engine speed at which idle speed control starts in two dimensional table look-up method; (5) the initial integral value of the integrated speed difference is determined to a lower value than a standard value of the predetermined engine speed at which idle speed control starts in order to decrease the absolute value of speed difference and thereby to reduce increments of engine controlling values; (6) the initial engine state variables are determined on the basis of an engine idle speed detected when a throttle value is fully closed and a predetermined engine speed at which idle speed control starts in two dimensional table look-up method; (7) a target engine idle speed is corrected according to engine operating conditions (coolant temperature, battery terminal voltage, air conditioning system); and (8) a feedforward control is additionally provided when a load (air conditioning system, power steering pump) is connected to or disconnected from the engine.

A method of feedback controlling engine idle speed to a target speed on the basis of mathematical dynamic models to determine engine state variables representative of engine dynamic behavior according to the present invention roughly comprises the following steps of: (1) calculating the difference between the target engine idle speed and the current engine speed; (2) integrating the calculated idle speed difference; (3) selecting an appropriate mathematical engine dynamic model according to at least one of predetermined engine operating conditions; (4) estimating low-order variables representative of engine internal dynamic state in accordance with the selected dynamic model and on the basis of at least one or two or more combinations of engine idle speed controlling parameters and controlled engine idle speed; and (5) determining the gains of the idle speed controlling parameters on the basis of the estimated state variables and the integrated idle speed difference.

BRIEF DESCRIPTION OF THE DRAWINGS

The features and advantages of the method of feedback controlling engine idle speed to a target speed according to the present invention over the prior-art method of controlling the same will be more clearly appreciated from the following description of the preferred embodiment of the invention taken in conjunction with the accompanying drawings in which like reference numerals designate the same or similar elements or sections throughout the figures thereof and in which:

FIG. 2 is a flowchart of the prior art engine idle speed control system shown in FIG. 1;

FIG. 3 is a schematic block diagram of an exemplary engine idle speed control system for realizing the method of feedback controlling engine idle speed according to the present invention on the basis of mathematical dynamic models to determine engine state variables representative of engine dynamic behavior;

DETAILED DESCRIPTION OF THE PREFERRED EMBODIMENTS

To facilitate understanding of the present invention, a brief reference will be made to a prior art engine idle speed control system with reference to the attached drawings.

Figure 1:
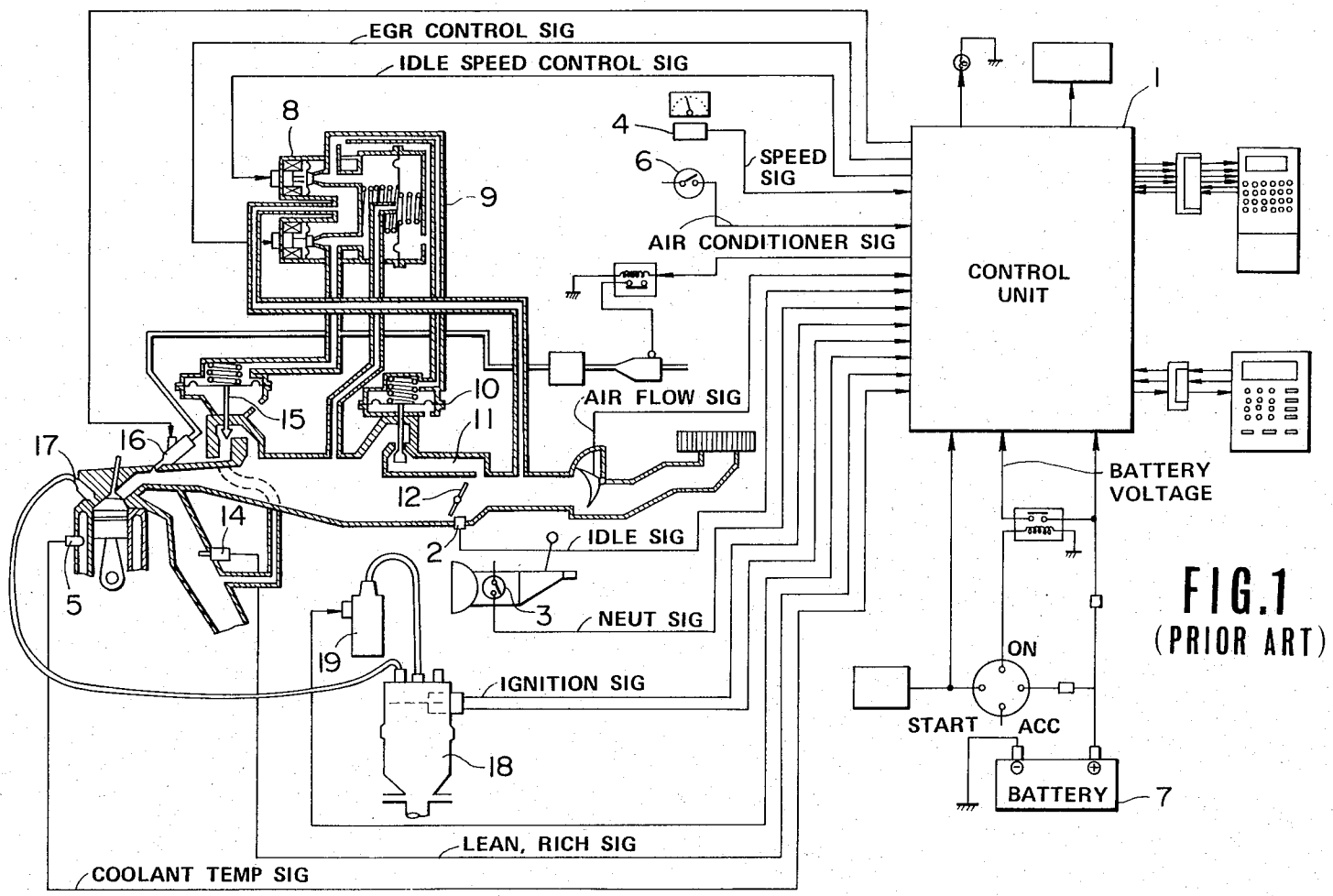
FIG. 1 (PRIOR ART)
FIG. 1 is a diagrammatical view of an example of a prior art engine idle speed control system, in which various sensors are connected to a control unit for feedback controlling various actuations.

FIG. 1 is an illustration of an example of a prior art engine idle speed control system; FIG. 2 is a flowchart of assistance in explaining prior art steps of feedback controlling engine idle speed to a target speed.

By a control unit shown in FIG. 1, the state where an engine is to be idled is detected on the basis of various signals such as an idle signal outputted from a throttle valve idle switch 2, a neutral signal outputted from a transmission idle switch 3, a vehicle speed signal outputted from a speed sensor 4, etc. (in block 1); a basic target engine idle speed is calculated according to a coolant temperature signal outputted from a coolant temperature sensor 5 in accordance with a linear look-up table; the calculated basic target engine idle speed is corrected in response to an air conditioning system signal outputted from an air conditioning system switch 6, a neutral signal outputted from a transmission idle switch 3, a battery voltage signal from a battery 7, etc., in order to obtain a target engine idle speed $N_r$ (in block 2); a current engine idle speed N is detected (in block 3); the difference SA in idle speed between the target value $N_r$ and the detected value N is calculated (in block 4); and the duty factor $P_A$ of an engine idle speed control signal is calculated on the basis of the calculated speed difference value SA (error signal) in accordance with a proportional control method (the magnitude of control signal is proportional to that of error signal), an integral control method (the magnitude of control signal is proportional to that of integral of error signal) or a proportional-plus-integral control method (in block 5).

In FIG. 1, when the idle speed controlling signal where duty factor is adjustable is applied from the control unit 1 to a control solenoid 8 of a vacuum valve 9, an idle speed control valve 10 is actuated according to the magnitude of vacuum adjusted by the vacuum valve 9, so that the quantity of air to be passed through a bypass passage 11 of a throttle valve 12, that is, the quantity of air supplied to the engine, is adjusted in order to control engine idle speed in accordance with the detected coolant temperature in consideration of other factors (air conditioning system, transmission, battery voltage, etc.)

Further, in FIG. 1, the reference numeral 13 denotes an air flow meter; the numeral 14 denotes an oxygen sensor activated when the exhaust gas is lean and deactivated when the exhaust gas is rich; the numeral 15 denotes an EGR (exhaust gas recirculation) value; the numeral 16 denotes a fuel injector; the numeral 17 denotes an ignition plug; the numeral 18 denotes a distributor; and the numeral 19 denotes an ignition coil.

In the prior art engine idle speed control system as described above with reference to FIGS. 1 and 2, however, the follow-up performance or the response speed of the control system is not sufficient, particularly in the transient state. This is because the conventional proportional/integral control system cannot operate at high response speed in response to the dynamic characteristics of the sensors and the actuators and additionally, the control system does not theoretically agree with the case where engine idle speed is feedback controlled in response to a plurality of controlling signals inputted to the control system.

Further, in the description above, in the case of an automotive vehicle, the transient states of engine idle speed occur when the engine is shifted from driving state to idling state or vice versa or when the engine is disturbed due to external torque disturbances (the clutch is engaged or disengaged; the air conditioning system is turned on or off; the power steering pump is connected to the engine while the vehicle is at rest), the engine thus presenting dynamic behavior.

In view of the above description, reference is now made to the embodiment of the method of feedback controlling engine idling speed to a target speed according to the present invention.

The object of this invention is to improve the follow-up performance or the response speed of the engine idling speed control system, even where an engine is in transient state or where the engine presents dynamic behavior in response to multivariable idle speed controlling signals so as to stably control engine idle speed at a target value without hunting (overshoot or undershoot).

To achieve the above-mentioned object, in the method according to the present invention, a multivariable engine idle speed control method is employed, instead of the conventional proportional/integral control method. In this method according to the present invention, a plurality of idle speed controlling input signals and the controlled idle speed output signal are feedbacked together and systematically. In more detail, mathematical dynamic engine state models representative of engine dynamic behavior including the dynamic characteristics of sensors and actuators are stored in a control unit usually made up of a microcomputer; at least one or two or more combinations of engine idle speed controlling parameters such as air quantity, ignition timing, fuel quantity and EGR (exhaust gas recirculation) quantity are inputted to the control unit as input signals; engine idle speed is outputted from the control unit as an output signal; multivariables representative of engine internal states are estimated on the basis of the stored mathematical dynamic engine models and the engine idle speed controlling parameters and the controlled idle speed; the idle speed controlling input valves are determined on the basis of the estimated state variables and the integral of the difference between the target engine idle speed and the actual engine idle speed value, so that engine idle speed is reliably feedback controlled to the target value even in the engine transient state.

With reference to FIG. 3, an embodiment of a control system for realizing the method of feedback controlling engine idle speed according to the present invention will be described hereinbelow.

In FIG. 3, the reference numeral 100 denotes an object to be controlled such as an internal combustion engine, for which air fuel ratio, fuel ignition timing, etc. are usually simultaneously feedback controlled; addition to idle speed feedback control. In this embodiment, an engine parameter to be controlled (controlled output signal) is engine idle speed N and engine parameters for controlling engine idle speed (controlling input signals) are at least one or two or more combinations of variables such as quantity of air bypassing a throttle valve (idle air flow rate), ignition timing (spark advance rate), quantity of fuel supplied to the engine (fuel flow rate) and quantity of exhaust gas recirculated from the engine (EGR rate).

To facilitate understanding of the embodiment, idle air quantity $P_A$ and ignition timing IT are taken as two controlling input signals. To change the quantity of air bypassing the throttle valve 12, the pulse width or the duty factor $P_A$ of a signal applied to the control solenoid 8 for actuating the idle speed control value 10 via the vacuum valve 9 is controlled. To change the advance angle of ignition signal, ignition timing IT is controlled.

The reference numeral 101 denotes a state observer in which mathematical dynamic modes are stored for estimating engine internal dynamic states $\hat{x}_i$ on the basis of two controlling input signals of idle air quantity $P_A$ and ignition timing IT and one controlled output signal of idle speed N. Further, this state observer 101 simulates an engine to be controlled, and the engine internal dynamic states are represented by low-order state variables $x_n$, for instance, four-order variables of $x_1$, $x_2$, $x_3$ and $x_4$.

As the state variables representative of the internal dynamic states of the engine 100 to be controlled, it may be possible to give as examples the absolute pressure or vacuum in the intake manifold, the quantity of air introduced into the engine cylinder, the dynamic behavior of fuel combustion, the magnitude of engine torque, etc. Therefore, if these parameters can be detected accurately by appropriate sensors with high response speed, it may be possible to detect the dynamic behavior of the engine and thereby to control the engine more accurately. At present, however, there are no sensors which can detect the above-mentioned parameters at high response speed. Accordingly, in the method according to the present invention, the above-mentioned parameters, that is, the engine internal dynamic states, are represented by state variables X. In these variables, it is unnecessary to allow the variables X to correspond to physical properties of the actual parameters indicative of engine internal state, but the variables are used for only simulating the engine state. Further, the greater the order n of the state variables, the greater the simulation accuracy, but, the more complicated the calculation, however.

Therefore, in this embodiment, the order n is determined to be four in the case where the number of controlling input signals $P_A$, IT is two and that of controlled output signals N is one. The resulting error due to approximation or due to difference in engine characteristics is absorbed or reduced depending upon integration operation.

The reference numeral 102 denotes a comparator which compares the predetermined target engine idle speed $N_r$ with the actually detected engine idle speed N and outputs a signal SA indicative of the difference between the two.

The reference numeral 103 denotes an integrator and gain controller, in which the signal SA indicative of difference ($N_r - N$) is integrated to obtain speed difference integral DUN and the increments of the two controlling input signals $\delta P_A$ and $\delta IT$ are calculated approximately in proportion to the absolute value of integral DUN of speed difference SA and on the basis of the estimated state variables $\hat{x}$ calculated by the state observer 101 and a gain selected according to engine operating conditions. The state observer 101, the comparator 102 and the integrator and gain controller 103 are all incorporated within a control unit made up of a microcomputer.

Further, in description of the embodiment of the present invention, it should be noted that engine speed is always controlled in such a way that engine speed at which the throttle valve is fully closed is always higher than a target idle speed and therefore a high engine speed is controlled to a lower engine idle speed. As a result, the difference $SA = (N_r - N)$ between the target value $N_r$ and the actual value N is always negative; the resulting integral DUN of speed difference SA is also negative. Therefore, in order to keep idle speed at a target value, the controlling input values must be increased.

The operation of the embodiment shown in FIG. 3 will be described hereinbelow.

The engine 100 is controlled by a two-input and one-output system. The internal dynamic state of the engine 100 can be estimated on the basis of an approximately linear transfer function matrix T(Z) which is obtained between two predetermined values in a sampled value group. The transfer function represents a mathematical relationship between output and input. In the case of a linear system, the transfer function can usually be obtained by dividing the output Laplace transformation by the input Laplace transformation (if initial value is zero).

The transfer function matrix T(Z) can be determined experimentally on the basis of engine operating conditions given when the engine is running near at an idling speed as follows:

$$T(Z) = [T_1(Z) T_2(Z)] \tag{1}$$

where $T_1(Z)$ denotes a first quadratic transfer function between the idle air quantity $P_A$ and the engine idle speed N and $T_2(Z)$ denotes a second quadratic transfer function between the ignition timing IT and the engine idle speed N and Z denotes Z-transformation of the sampled values of each input and output signal. The Z-transformation of a sequence with a general term of $f_n$ is expressed as the sum of series with a general term of $f_n Z^{-n}$, where Z denotes a complex variable.

Figure 4:
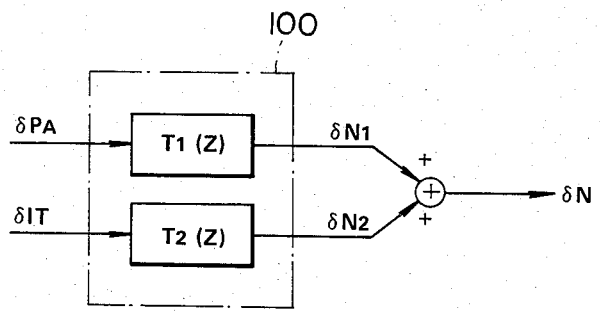
FIG. 4 is a schematic block diagram of assistance in explaining the relationship between engine controlling parameters and controlled engine idle speed, both shown in FIG. 3.

FIG. 4 is a mathematical structure showing the first transfer function $T_1(Z)$ obtained between the input $\delta P_A$ and the output $\delta N_1$ and the second transfer function $T_2(Z)$ obtained between the input $\delta IT$ and the output $\delta N_2$, where the input and output values are expressed as deviations from the predetermined standard values.

On the basis of the above-mentioned transfer function T(Z), it is possible to construct the state observer 101 as follows: First, an engine internal state variable model representative of engine dynamic behavior can be introduced from the transfer function matrix T(Z) as follows:

$$X(n) = AX(n-1) + Bu(n-1) \tag{2}$$

$$y(n-1) = CX(n-1) \tag{3}$$

Here, n denotes a current sample data, (n − 1) denotes a preceding sample data, u denotes a controlling input vector expressed as a perturbation (a deviation from a predetermined reference value within a range where linear approximation is established). Since the pulse width $\delta P_A$ of the control solenoid 8 and the ignition timing $\delta IT$ are taken as the controlling input vectors in this embodiment, u can be expressed as $$u(n-1) = \begin{pmatrix} \delta P_A(n-1) \\ \delta IT(n-1) \end{pmatrix} \tag{4}$$

Further, y denotes a controlled output vector also expressed as a perturbation. Since the engine idle speed $\delta N$ is taken as the controlled output vector in this embodiment, y can be expressed as $$y(n-1) = \delta N(n-1) \tag{5}$$

X denotes state variable vectors and matrices A B C are constant coefficient matrices determined by coefficients of the transfer function matrix T(Z).

Here, a state observer having the following algorithm is constructed:

$$\hat{X}(n) = (A - GC)\hat{X}(n-1) + Bu(n-1) + Gy(n-1) \tag{6}$$

where G denotes a given matrix, $\hat{X}$ denotes estimated values of engine internal state variables X. If $u(n-1)$ and $y(n-1)$ are eliminated by the expressions (2) and (3), the above expression (6) can be given as $$[X(n) - \hat{X}(n)] = (A - GC)[X(n-1) - \hat{X}(n-1)] \tag{7}$$

Therefore, if G is so determined that the eigen value of the matrix (A − GC) lies within a unit circle, When $$n \rightarrow \text{greater}, \hat{X}(n) \rightarrow X(n) \tag{8}$$

This means that it is possible to estimate the engine internal state variables X(n) on the basis of the input u and output y. Further, in the above expression (7), it is also possible to determine all the eigen values of the matrix (A − GC) to be zero by appropriately determining the matrix G. In this case, the state observer 101 is called a finite setting state observer.

Figure 5:
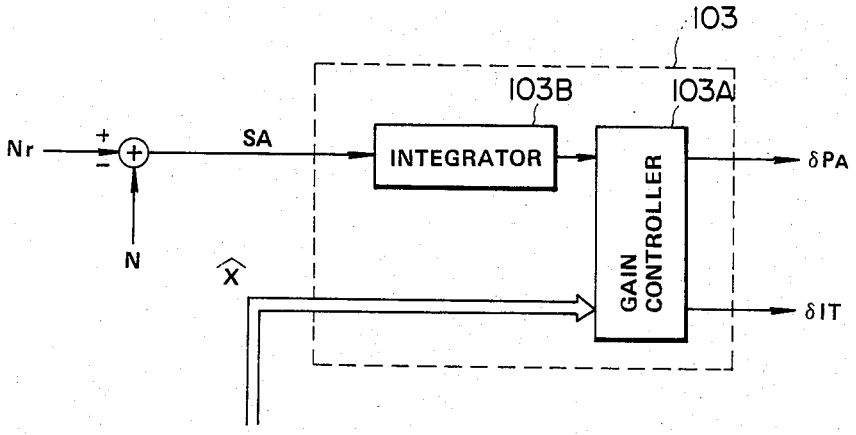
FIG. 5 is a schematic block diagram of assistance in explaining the functions of an integrator and a gain controller shown in FIG. 3.

With reference to FIG. 5, the function of the state observer 103 will be described hereinbelow. The estimated state variables $\hat{X}$ are directly applied to a gain controller 103A. The difference $SA = (N_r - N)$ between the target engine idle speed $N_r$ and the actually-detected engine idle speed N is indirectly applied to the gain controller 103A via an integrator 103B. The gain controller 103A determines a first controlling input increment $\delta P_A$ (duty factor of a signal applied to the control solenoid 8 or idle air flow rate) from a predetermined reference value $(P_A)_a$ within a range where linear approximation can be established and a second controlling input increment $\delta IT$ (ignition timing or spark advance rate) from a predetermined reference value $(IT)_a$ within a range where linear approximation can be established, in order to control the engine idle speed N to a constant target value $N_r$. Further in this embodiment, since the order of the mathematical models determined by experiments is determined to be low (n=4), the difference SA is integrated through the integrator 103B for averaging or leveling the error due to low-order approximation.

In this embodiment, since the engine idle speed is controlled to a constant value by means of two-input and one-output system, only the simple control algorithm has been described. The more generic control algorithm adopted for a multivariable control system has already been described in some books, for instance, "Control theory of linear systems" by Katsuhisa Furuta. Therefore, only the results will simply be described hereinbelow.

Now, assumption is made that the controlling input u, the controlled output y and an evaluation function J are $$\delta u(n) = u(n) - u(n-1) \tag{9}$$

$$\delta y(n) = N_r - N(n) \tag{10}$$

$$J = \sum_{k=o}^{\infty} (\delta y(k)^2 + \delta u^t(k)\, R\, \delta u(k)) \tag{11}$$

where R denotes a weighted parameter matrix, t denotes the transposition, and k denotes the number of sampled values when the control start time point is set to zero. Further, the second term on the right side of expression (11) represents the square of expression (9) when R is a diagonal matrix. The second term of expression (11) is expressed as a quadric form of difference in controlling input as expressed in the expression (9). This is because integration operation is provided as shown in FIG. 5.

The most appropriate controlling input u*(k) to minimize the evaluation function J of expression (11) can be expressed as $$u^*(k) = -(R + \overline{B}^t p\, \overline{B})^{-1}\, \overline{B}^t p\, \overline{A} \left| \begin{matrix} \sum_{j=0}^{k} (N_r - N(j)) \\ \hat{X}(k) \end{matrix} \right| \tag{12}$$

In expression (12), if $$K = -(R + \overline{B}^t p\, \overline{B})^{-1}\, \overline{B}^t P\, \overline{A} \tag{13}$$

K denotes an appropriate gain matrix. Further, in expression (12), since $$\overline{A} = \begin{pmatrix} 1 & -CA \\ 0 & A \end{pmatrix} \tag{14}$$

$$\overline{B} = \begin{pmatrix} -CB \\ B \end{pmatrix} \tag{15}$$

P can be expressed as the solution of Riccati equation as follows:

$$P = \overline{A}^t PA - \overline{A}^t p\, \overline{B}(\overline{B}^t p\, \overline{B} + R)^{-1}\, \overline{B}^t p\, \overline{A} + \begin{pmatrix} 10 \\ 00 \end{pmatrix} \tag{16}$$

The evaluation function J of expression (11) serves to minimize the difference SA between the target idle speed $N_r$ and the actual idle speed N, while restricting the variation in the controlling input u. The weight of restriction can be changed by the weighted parameter matrix R. Therefore, when an appropriate R is selected, P can be solved in accordance with an appropriate engine dynamic state model of when an engine is being idled and expression (16). Thereafter, an appropriate gain matrix K can be calculated on the basis of the solved P in accordance with expression (13). The gain matrix K is stored in the gain controller. Accordingly, it is possible to determine appropriate controlling input values u*(k) which can be obtained on the basis of the integral of difference SA between the target idle speed $N_r$ and the actual idle speed N and the estimated state variables $\hat{X}(k)$ in accordance with expression (12). Further, as already described, the estimated values $\hat{X}(k)$ of engine dynamic state variables can be obtained on the basis of constant-coefficient matrixes A, B, C and D which are determined by transfer function matrices T(Z) and stored in the microcomputer in accordance with expression (6).

Now, the features of the method of feedback controlling engine idle speed according to the present invention will be described hereinbelow with reference to FIGS. 6 to 14.

The first feature of the present invention is how to set the initial values $\hat{X}(0)$ of state variables and further how to set the initial value DUN(0) of integral of difference SA between the target engine speed $N_r$ and the actually detected engine speed N according to the engine state where the system begins to control engine idle speed.

When the throttle valve is fully closed and further engine idle speed drops below a predetermined value (e.g. 900 rpm), the idle speed control system determines that control must be started and therefore the system begins to operate. Upon operation, the state observation also begins to operate. In this case, as is well understood in expression (6), it is necessary to give initial values $\hat{X}(0)$ of engine internal state variables X. In more detail, if an engine idle speed at the time when idle speed control is required to start is 900 rpm, the initial values $\hat{X}(0)$ are preset to near 900 rpm in order to accurately carry out the succeeding estimation at high speed. By setting the initial values $\hat{X}(0)$, it is possible to improve the controllability in the transient state where the engine speed drops from 900 rpm to the target value (e.g. 650 rpm), after the engine has been allowed to coast (an engine is operated by the inertia of the vehicle after the transmission is shifted to the neutral position), and to prevent the engine from being stopped due to coasting.

However, even if the control begins at an engine speed of 900 rpm, the engine internal state variables obtained when the throttle valve is fully closed at 2000 rpm and thereafter the idle speed drops to 900 rpm are different from those obtained when the throttle valve is fully closed at 4000 rpm and thereafter the idle speed drops to 900 rpm. Therefore, in order to give a correct estimation, it is necessary to determine the initial values $\hat{X}(0)$ according to two factors of the first engine idle speed at which the throttle valve is fully closed and the second engine idle speed at which the control begins to start. That is to say, the initial values $\hat{X}(0)$ of engine internal state variables X must be given according to these two factors when control starts and the state variables $\hat{X}$ must be calculated on the basis of the initial values $\hat{X}(0)$ determined by the above-mentioned two factors in accordance with the expression (6). The above-mentioned initial values $\hat{X}(0)$ are previously determined by the method of computer simulation and stored in the controller (microcomputer) as a two-dimensional look-up table of two engine speeds of when the throttle valve is fully closed and when the idle speed control begins.

Further, when the control system determines that idle speed must be controlled, the integral of the difference between the target value $N_r$ and the detected actual value N is given as $$DUN(0) = \sum_{j=0}^{0} (N_r - N(j))$$

in the expression (12). Therefore, if $N_r$ is 650 rpm and N is 900 rpm, the initial integral value DUN(0) is −250 rpm. However, in this case, since the absolute value of this initial integral value DUN(0) is two great, the controlling input signal (e.g. $P_A$) is controlled excessively to a smaller value, thus resulting in undershooting (controlled idle speed drops below the target value $N_r$) or engine stop while the engine is coasting. In order to prevent the undershooting or engine stop, the actual engine speed N is apparently set to near or below the target idle speed $N_r$. For instance, if $N_r$ is 650 rpm and the pseudo speed N' is set to apparently 700 rpm, the initial integral value DUN(0) is −50 rpm. Therefore, since the absolute value of this initial integral value DUN(0) is moderately small, the controlling input signal (e.g. $P_A$) is controlled moderately. In this case, although the response speed to engine speed is a little deteriorated, it is possible to stably control the idle speed to the target value without undershooting or engine stop while engine is coasting.

Figure 6A:
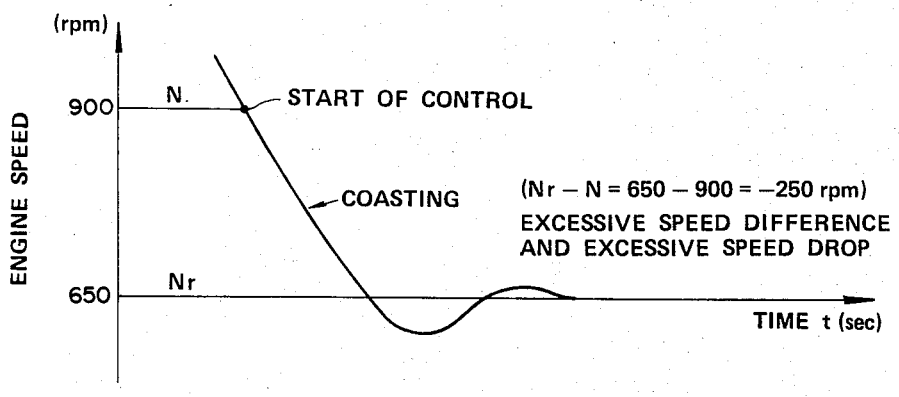
FIGS. 6(A) is a graphical representation showing an experimental result of engine idle speed variation obtained by a method of controlling engine idle speed on the basis of mathematical dynamic models in which the initial integral value of idle speed difference ($N_r-N$) is set to a greater absolute value in the transient state where the engine is allowed to coast from an unload high engine speed to a target value of 650 rpm.

FIG. 6(A) shows an experimental result obtained where the initial idle speed difference SA(0) is set to ($N_r - N = 650 - 900 = -250$ rpm) in the transient state where the engine is allowed to coast from a high engine speed to the target engine speed of 650 rpm, with the initial detected idle speed set to 900 rpm obtained when the idle switch 2 is closed. This Figure indicates that the controlled engine speed drops below the target value of 650 rpm, that is, there exists undershooting, because of an excessive initial integral value DUN(0) speed difference.

Figure 6B:
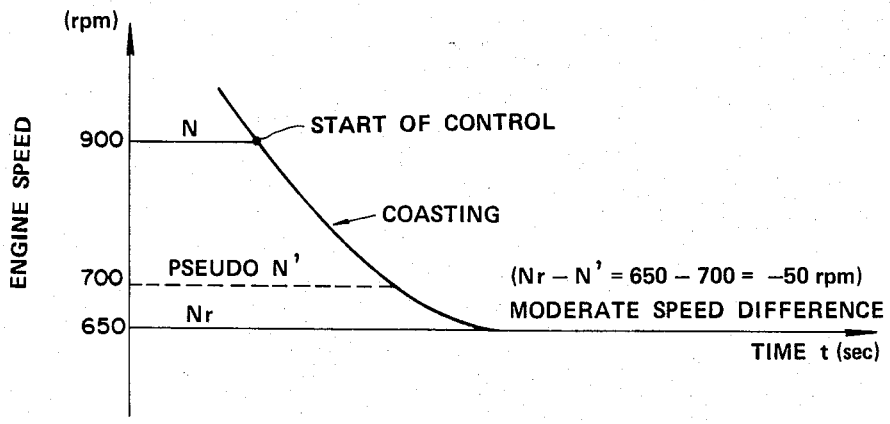
FIG. 6(B) is a graphical representation showing an experimental result of engine idle speed variation obtained by the method of controlling engine idle speed on the basis of mathematical dynamic models according to the present invention in which the initial integral value of idle speed difference ($N_r-N$) is set to a smaller absolute value in the same transient state as in FIG. 6(A)

In contrast with this, FIG. 6(B) shows an experimental result obtained where the initial idle speed difference is set to ($N_r - N = 650 - 700 = -50$ rpm), in the same transient state as in FIG. 6(A), with the pseudo initial detected idle speed set to 700 rpm. This figure indicates a relatively preferred response characteristic.

Figure 7A:
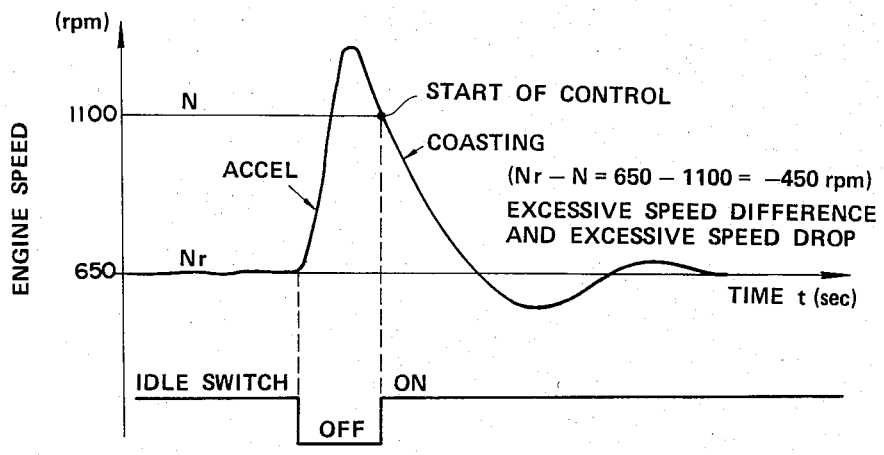
FIG. 7(A) is a graphical representation showing an experimental result of engine idle speed variation obtained by a method of controlling engine idle speed on the basis of mathematical dynamic models in which the initial integral value of idle speed difference value ($N_r-N$) is set to a greater absolute value in the transient state where the engine is allowed to coast to a target value of 650 rpm after the engine has been accelerated during idling.

Further, FIG. 7(A) shows an experimental result obtained where the initial idle speed difference SA(0) is set to ($N_r - N = 650 - 1100 = -450$ rpm) in the transient state where the engine is allowed to coast to a target value of 650 rpm after the engine has been accelerated during idling, with the initial detected idle speed set to 1100 rpm obtained when the idle switch 2 is closed. This figure indicates that the controlled engine speed drops below the target value of 650 rpm, that is, there exists undershooting.

Figure 7B:
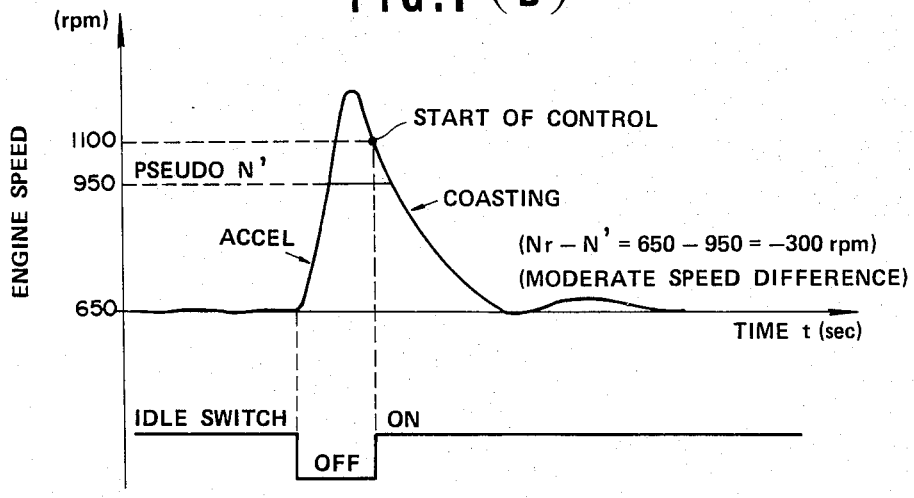
FIG. 7(B) is a graphical representation showing an experimental result of engine idle speed variation obtained by the method of controlling ending idle speed on the basis of mathematical dynamic models according to the present invention in which the initial integral value of idle speed difference value ($N_r-N$) is set to a smaller absolute value in the same transient state as in FIG. 7(A)

In contrast with this, FIG. 7(B) shows an experimental result obtained where the initial idle speed difference SA(0) is set to ($N_r - N' = 650 - 950 = -300$ rpm), in the same transient state as in FIG. 7(A), with the pseudo initial detected idle speed N' set to 950 rpm. This figure indicates a relatively preferred response characteristic.

These drawings indicate that when an excessive initial integral value DUN(0) in absolute value is inputted to the system, engine speed is excessively controlled to a lower value dropping below the target value $N_r$ causing hunting or engine stop; however, when a moderate initial integral value in absolute value is inputted to the system by apparently setting the actual engine speed N to a lower pseudo speed N', engine speed is moderately controlled to the target value $N_r$ without causing hunting or engine stop.

The second feature of the present invention is to select an appropriate mathematical dynamic model and an appropriate gain K according to engine operating conditions, for instance, according to coolant temperature $T_w$, rich or lean conditions of exhaust gas (activation or deactivation of an oxygen sensor).

Usually, engine dynamic behavior varies according to the engine operating conditions, that is, when the coolant temperature changes or when air-fuel mixture changes from rich to lean or vice versa (an oxygen sensor is deactivated when rich and activated when lean). Therefore, if the engine dynamic behavior changes markedly, it is impossible to effectively control the engine idle speed on the basis of a single dynamic mathematical model experimentally obtained under restricted conditions in accordance with the expressions (2) and (3). Therefore, in the present invention, parameters to detect the change in engine dynamic behavior are previously determined, and the various predetermined dynamic models suitable to various engine operating conditions are stored in the microcomputer and selected according to the detected engine parameters, in order to appropriately control engine idling speed. In this case, the constant coefficient matrices A, B, C and G preset in the state observer 101 shown in the expressions (2), (3), (6) and (7) are changed and the appropriate gain K shown in the expression (13) is also appropriately selected.

In the present invention, coolant temperature and oxygen sensor activation state are selected as the above-mentioned parameters.

The reason why the oxygen sensor value is selected is as follows: When the oxygen sensor is cooled and therefore is disabled without detecting rich or lean state of exhaust gas, the air-fuel ratio feedback control is clamped at a fixed value. That is to say, while the oxygen sensor is fixed at the deactivated state, the mixture ratio is controlled to lean side or rich side. When the mixture rate is set to the rich side, the engine dynamic behavior changes markedly, thus severely deteriorating the controllability of engine idle speed. Therefore, even when the state of the oxygen sensor changes, it is necessary to change the constant-coefficient matrices A, B C and D and the appropriate gain K preset in the state observer 101.

The transient response characteristics against disturbance under the condition that the target idle engine speed is constant will be described hereinbelow.

Figure 8A:
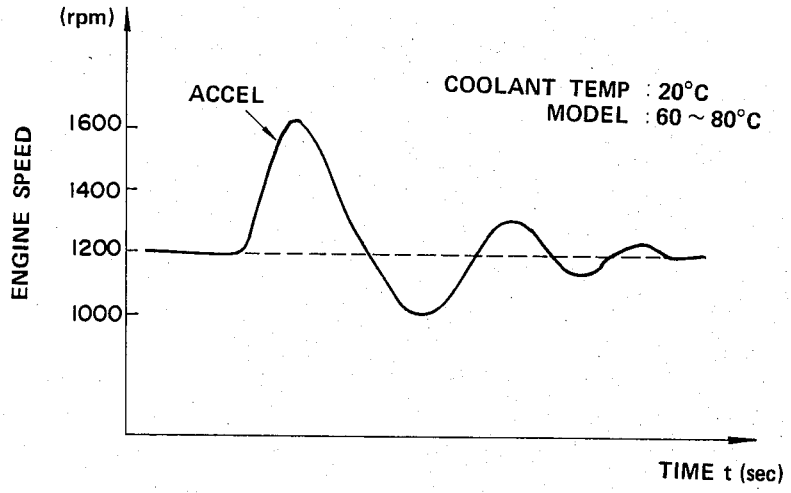
FIG. 8(A) is a graphical representation showing an experimental result of engine idle speed variation obtained by a method of controlling engine idle speed on the basis of mathematical dynamic models in which a fixed dynamic model for coolant temperature of 60° to 80° C. is adopted at a coolant temperature of 20° C. in the transient state where the engine is allowed to coast to a target value of 1200 rpm after the engine has been accelerated during idling.

FIG. 8(A) shows an experimental result obtained by the control system in which a single dynamic model is prepared irrespective of coolant temperature in the transient state where the engine is allowed to coast to a target value of 650 rpm after the engine has been accelerated during idling. In this drawing, the control system is set to an appropriate gain K, the dynamic model is so determined as to be suitable to a coolant temperature of from 60° to 80° C., and the engine is accelerated when the coolant temperature is about 20° C. This figure indicates that the controlled engine idle speed drops repeatedly below the target value of 650 rpm, while undershooting and overshooting, that is, hunting.

Figure 8B:
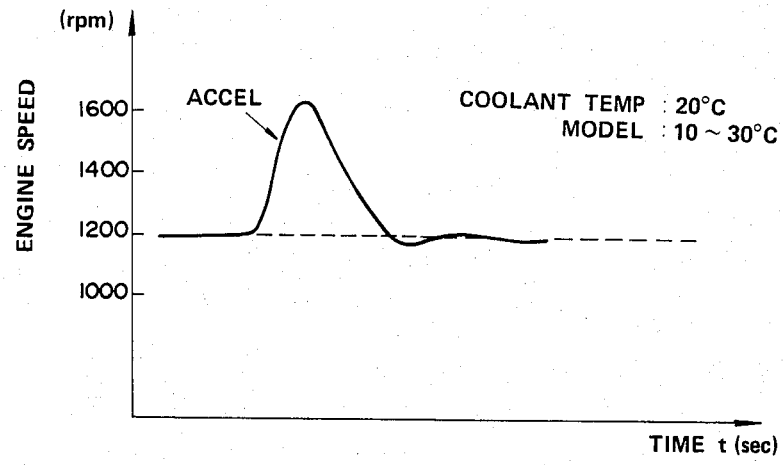
FIG. 8(B) is a graphical representation showing an experimental result of engine idle speed variation obtained by the method of controlling engine idle speed on the basis of mathematical dynamic models according to the present invention in which the dynamic mode is selected according to the coolant temperature in the same transient state as in FIG. 8(A)

FIG. 8(B) shows an experimental result obtained where a plurality of dynamic models are prepared for coolant temperatures, in the transient state where the engine is allowed to coast to a target value of 650 rpm after the engine has been accelerated during idling. In this drawing, the control system is set to an appropriate gain K, the dynamic model is so determined as to be suitable to a coolant temperature of from 10° to 30° C., and the engine is accelerated when the coolant temperature is about 20° C.

The figures, clearly indicate that it is possible to obtain a more preferable controllability when the dynamic model is appropriately selected according to coolant temperature.

Figure 9A:
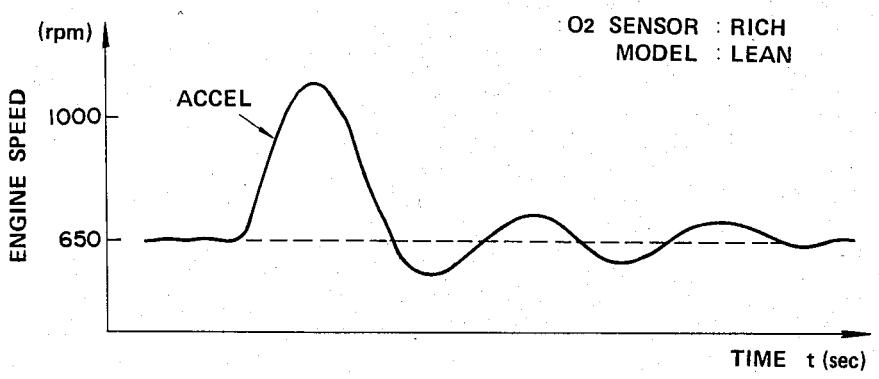
FIG. 9(A) is a graphical representation showing an experimental result of engine idle speed variation obtained by a method of controlling engine idle speed on the basis of mathematical dynamic models in which a fixed (lean) dynamic model is adopted irrespective of the active state of an oxygen sensor in the transient state where the engine is allowed to coast to a target value of 650 rpm after the engine has been accelerated and when the oxygen sensor detects rich exhaust gas.

FIG. 9(A) shows an experimental result obtained where a single dynamic model is prepared irrespective of the state of the oxygen sensor in the transient state where the engine is allowed to coast to a target value of 650 rpm after the engine has been accelerated during idling. In this drawing, the control system is set to an appropriate gain K, the dynamic model is so determined as to be suitable to the state where the oxygen sensor is activated or indicates "lean", and the engine is accelerated when the oxygen sensor is deactivated or indicates "rich". This figure indicates that the controlled engine idle speed drops repeatedly below the target value of 650 rpm, while undershooting and overshooting, that is, hunting.

Figure 9B:
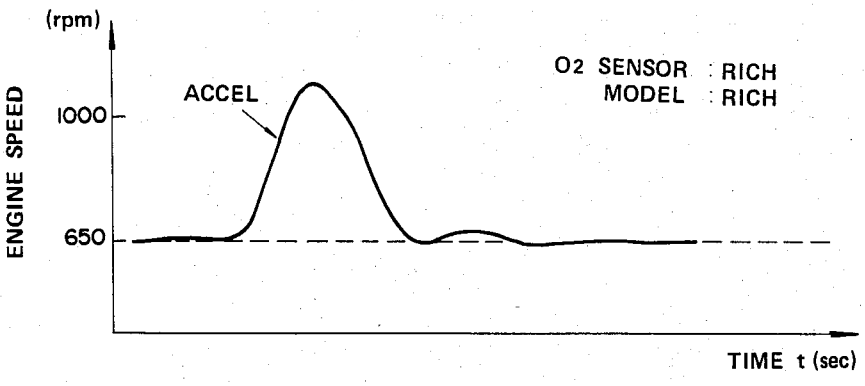
FIG. 9(B) is a graphical representation showing an experimental result of engine idle speed variation obtained by the method of controlling engine idle speed on the basis of mathematical dynamic models according to the present invention in which a selected (rich) dynamic model is selected in the same transient state as in FIG. 9(A)

FIG. 9(B) shows an experimental result obtained where two dynamic models are prepared for the states of the oxygen sensor in the transient state where the engine is allowed to coast to a target value of 650 rpm after the engine has been accelerated during idling. In the drawing, the control system is set to an appropriate gain K, the dynamic model is so determined as to be suitable to the state where the oxygen sensor is deactivated or indicates "rich", and the engine is accelerated when the oxygen sensor is deactivated or indicates "rich".

The figures clearly indicate that it is possible to obtain a more preferable controllability when the dynamic model is appropriately selected according to the state of the oxygen sensor.

The third feature of the present invention is to feedforward control engine idle speed, in addition to the already-described feedback control, in order to further improve the controllability in the transient state where predictable loads are connected to the engine. The above predictable loads are air conditioning system load, power steering pump load, vehicle running load applied to the engine when the clutch is engaged therewith, etc., which are all previously detectable by sensor signals generated from appropriate switches closed when the above loads are connected to the engine. Further, in the feedforward control, the magnitude of the controlling input signals ($\delta P_A$, $\delta IT$) is increased by a predetermined value when a load is additionally connected to the engine and is decreased by that value when that load is disconnected from the engine.

Figure 10A:
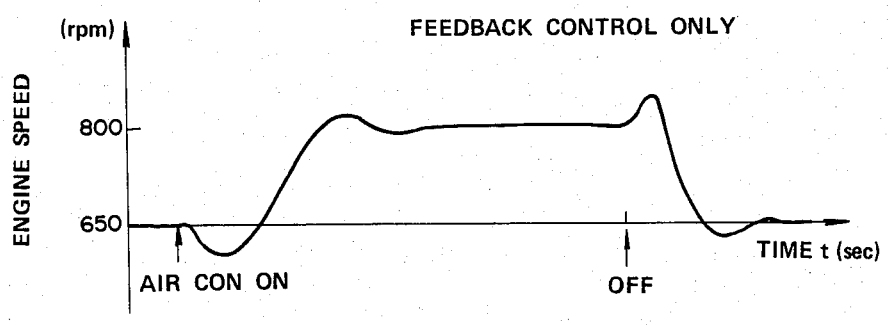
FIG. 10(A) is a graphical representation showing an experimental result of engine idle speed variation obtained by a method of controlling engine idle speed on the basis of mathematical dynamic models in the transient state where an air conditioning system is turned on with the target idle engine speed set to 800 rpm and further the air conditioning system is turned off with the target idle engine speed set to 650 rpm.

FIG. 10(A) shows an experimental result of engine idle speed controlled by the system in which only the feedback control is carried out, in the transient state where an air conditioning system is turned on with the target idle speed set to 800 rpm and further the system is turned off with the target idle speed reset to the original speed of 650 rpm. In the drawing, the engine idle speed decreases markedly when the air conditioning system is turned on and increases markedly when the system is turned off.

Figure 10B:
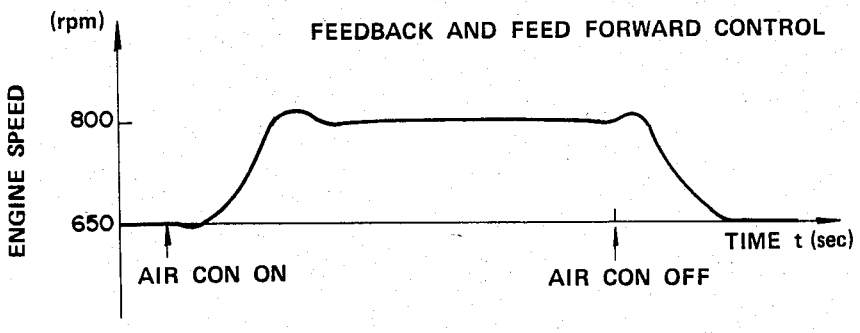
FIG. 10(B) is a graphical representation showing an experimental result of engine idle speed variation obtained by the method of controlling engine idle speed on the basis of mathematical dynamic models according to the present invention in which feedforward control is provided in addition to feedback control in the same transient state as in FIG. 10(A)

FIG. 10(B) shows an experimental result of engine idle speed controlled by the system in which both the feedback control and the feedforward control are carried out in the same transient condition as in FIG. 10(A). In the drawing, when the air conditioning system is turned on, the duty factor of a signal applied to the control solenoid 8 for the vacuum valve 9 is increased by a predetermined value (e.g. 4 ms) in order to increase the amount of air bypassing the throttle valve 12, that is, to increase the engine idle speed. When the air conditioning system is turned off, the duty factor is decreased to the original value.

These drawings indicate that it is possible to obtain a more preferable controllability when feedforward control is additionally provided in the feedback control system.

Figure 11A:
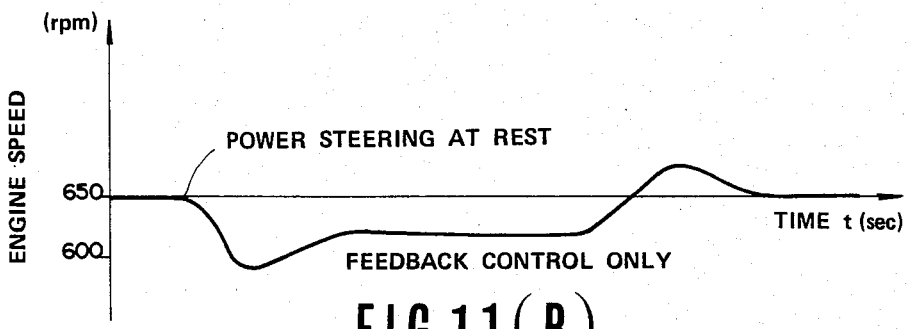
FIG. 11(A) is a graphical representation showing an experimental result of engine idle speed variation obtained by a method of controlling engine idle speed on the basis of mathematical dynamic models in the transient state where a power steering pump is connected or disconnected to or from the engine with the target idle speed set to 650 rpm.

FIG. 11(A) shows an experimental result of engine idle speed controlled by the system in which only the feedback control is carried out in the transient state where a power steering pump is connected to the engine when the vehicle is at rest. In the drawing, the engine idle speed decreases markedly when the power steering pump is connected to the engine and increases when the pump is disconnected from the engine.

Figure 11B:
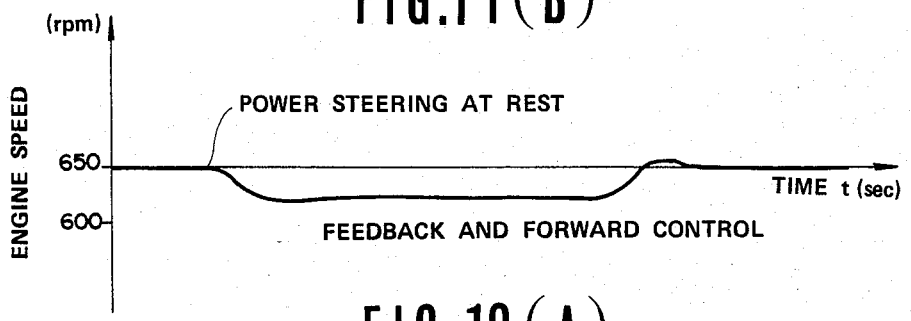
FIG. 11(B) is a graphical representation showing an experimental result of engine idle speed variation obtained by the method of controlling engine idle speed on the basis of mathematical dynamic models according to the present invention in which feedforward control is provided in addition to feedback control in the same transient state as in FIG. 11(A)

FIG. 11(B) shows an experimental result of engine idle speed controlled by the system in which both the feedback control and the feedforward control are carried out in the same transient condition as in FIG. 11(A). In the drawing, when the power steering pump is connected to the engine, the duty factor of a signal applied to the control solenoid 8 for the vacuum valve 9 is increased by a predetermined value in order to increase the amount of air bypassing the throttle valve 12, that is, to increase the engine idle speed. When the power steering pump is disconnected from the engine, the duty factor is decreased to the original value.

These drawings also indicate that it is possible to obtain a more preferable controllability when feedback control is additionally provided in the feedback control system.

The fourth feature of the present invention is to set a first appropriate servo control gain $K_1$ for general disturbance (e.g. engine misfire) and a second appropriate servo control gain $K_2$ for predictable or detectable disturbances (e.g. air conditioning system connection) in response to switch signals, in order to further improve the controllability in the transient state.

Figure 12A:
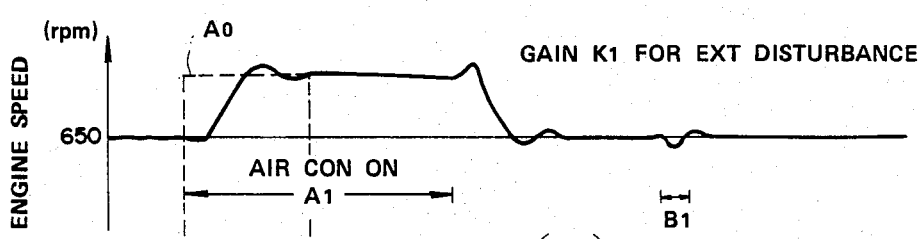
FIG. 12(A) is a graphical representation showing an experimental result of engine idle speed variation obtained by a method of controlling engine idle speed on the basis of mathematical dynamic models in which a first gain $K_1$ for external disturbance is set in the transient state where an air conditioning system is turned on and off (during period $A_1$) and external torque disturbances are added (during period $B_1$)

FIG. 12(A) shows an experimental result obtained by the control system in which a first gain $K_1$ is set in the transient state where an air conditioning system is connected to and then disconnected from the engine (during period $A_1$) and further external engine torque disturbances are added (during period $B_2$). In the drawing, $A_0$ denotes a target idle speed when the air conditioning system is connected to the engine.

Figure 12B:
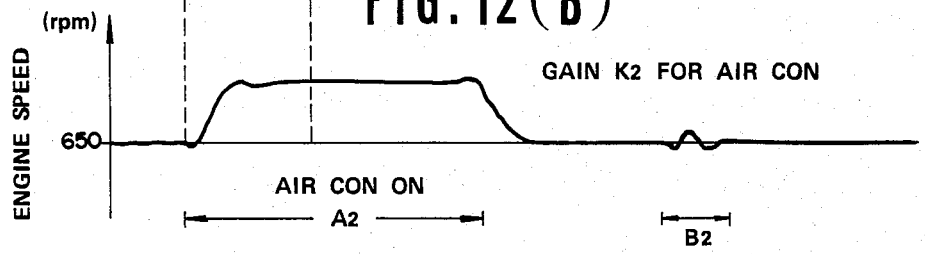
FIG. 12(B) is a graphical representation showing an experimental result of engine idle speed variation obtained by a method of controlling engine idle speed on the basis of mathematical dynamic models in which a second gain $K_2$ for air conditioning system is set in the same transient state as in FIG. 12(A)

FIG. 12(B) shows an experimental result obtained by the control system in which a second gain $K_2$ is set in the same transient state as in FIG. 12(A).

In FIG. 12(A), since the first gain $K_1$ is so predetermined as to be suitable to control external engine torque disturbance, the controllability is superior only during the period $B_1$ (when external disturbance is added to the engine) but not superior during the period $A_1$ (when the air conditioning system is connected to or disconnected from the engine). In FIG. 12(B), since the second gain $K_2$ is so predetermined as to be suitable to control the air conditioning system disturbance, the controllability is superior only during period $A_2$ (when the air conditioning system is connected to or disconnected from the engine) but not superior during period $B_2$ (when external disturbance is added to the engine). In other words, these drawings indicate that it is desirable to select the first gain $K_1$ for controlling external disturbance and the second gain $K_2$ for controlling the predictable disturbance due to connection or disconnection of air conditioning system.

The fifth feature of the present invention is (1) to detect that an uncontrollable great external disturbance is applied to the engine on the basis of the fact that the controlling input values $P_A$ and IT (idle air flow rate bypassing the throttle valve and spark advance rate) reach the respective lower limits in spite of the fact that engine idle speed is not controlled at the target value, (2) to cancel the estimated engine internal state variables $\hat{X}$ and the integral DUN of the speed difference SA immediately after the engine speed drops below the target value $N_r$ due to removal of the external disturbance, and (3) to set the controlling input values to reference values (e.g. duty factor is 27% and ignition timing is 21°), in order to prevent the engine idle speed from dropping below the target value after the engine is released from the uncontrollable great external disturbance.

This is because the case exists where the engine stops suddenly for the following reason: when the engine is being idled, if unpredictable and uncontrollable external disturbance is applied to the engine, the engine is kept running at a speed higher than the target value for a relatively long time period. Under these conditions, the quantity of air bypassing the throttle value is set to the lower limit and also the ignition timing is set to the lower limit (toward the direction that the timing is delayed for lowering engine speed). However, when the external disturbance is removed suddenly, the idle air flow rate or the ignition timing cannot be controlled toward the direction that the engine speed is increased at high response speed because of the presence of integration operation, so that the engine is stopped.

Figure 13A:
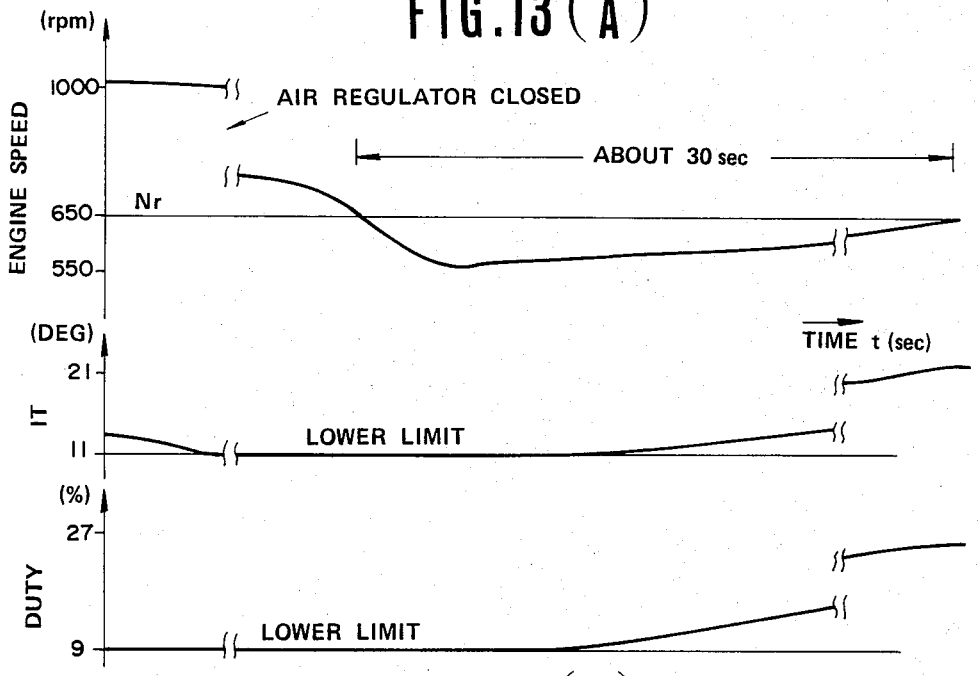
FIG. 13(A) is graphical representations showing an experimental result of engine idle speed variation, ignition timing and duty factor obtained by a method of controlling engine idle speed on the basis of mathematical dynamic models when an uncontrollable air disturbance (air regulator) is applied to or removed from the engine.

FIG. 13(A) shows an experimental result of the engine speed, ignition timing IT and duty factor $P_A$ obtained when an uncontrollable air disturbance is applied to and removed from the engine. To explain the abovementioned danger of engine stop in more detail with reference to FIG. 13(A), when the engine is started, if the coolant temperature is low, the target engine idle speed is usually set to a higher value. In this case, since it is impossible to increase the engine speed only by increasing the duty factor $P_A$ of the control signal applied to the vacuum solenoid to increase the quantity of air bypassing the throttle valve, an air regulator is further installed for supplying air to the engine. Therefore, the sum of the air supplied by the air regulator and the air supplied by the vacuum valve is introduced into the engine. The air supplied by the air regulator is decreased gradually as the coolant temperature increases. Under these conditions, in case the quantity of air supplied from the air regulator is sufficiently great beyond the quantity determined on the basis of coolant temperature, the engine idle speed exceeds far beyond the target value of 650 rpm, so that the ignition timing is set to the lower limit of 11 degrees and the duty factor is also set to the lower limit of 9 percent, for instance. In these conditions, when the air regulator is closed suddenly, the engine speed drops suddenly far below the target value of 650 rpm, and the control system beings to operate to increase the engine speed, that is, to increase the spark advance rate and the duty factor. However, if the engine speed is kept at a higher value for a long time, since a great integral value DUN of the speed difference SA between the target value $N_r$ and the actual value N is stored in the microcomputer, it takes a greater amount time to eliminate the influence of the stored integral, thus causing engine stop.

Figure 13B:
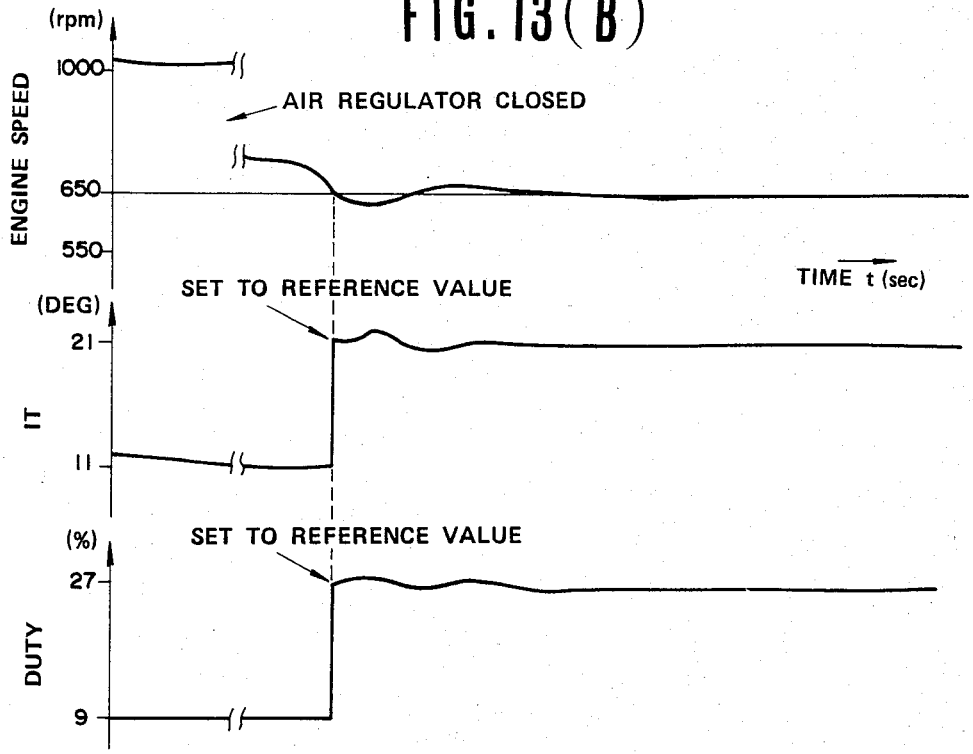
FIG. 13(B) is graphical representations showing an experimental result of engine idle speed variation, ignition timing and duty factor obtained by the method of controlling engine idle speed on the basis of mathematical dynamic models according to the present invention when the ignition timing and the duty factor are once cancelled and set to the predetermined reference values after uncontrollable air disturbance (air regulator) is removed from the engine.

FIG. 13(B) shows an experimental result of engine speed, ignition timing and duty factor obtained when the ignition timing and the duty factor are once cancelled and set to the predetermined reference values (timing is 21 degrees; duty is 27 percent) after uncontrollable air disturbance is removed from the engine and when the engine speed reaches the target value $N_r$. This drawing indicates that the engine speed can be controlled to the target value quickly even after the external disturbance is removed suddenly.

Figure 14A:
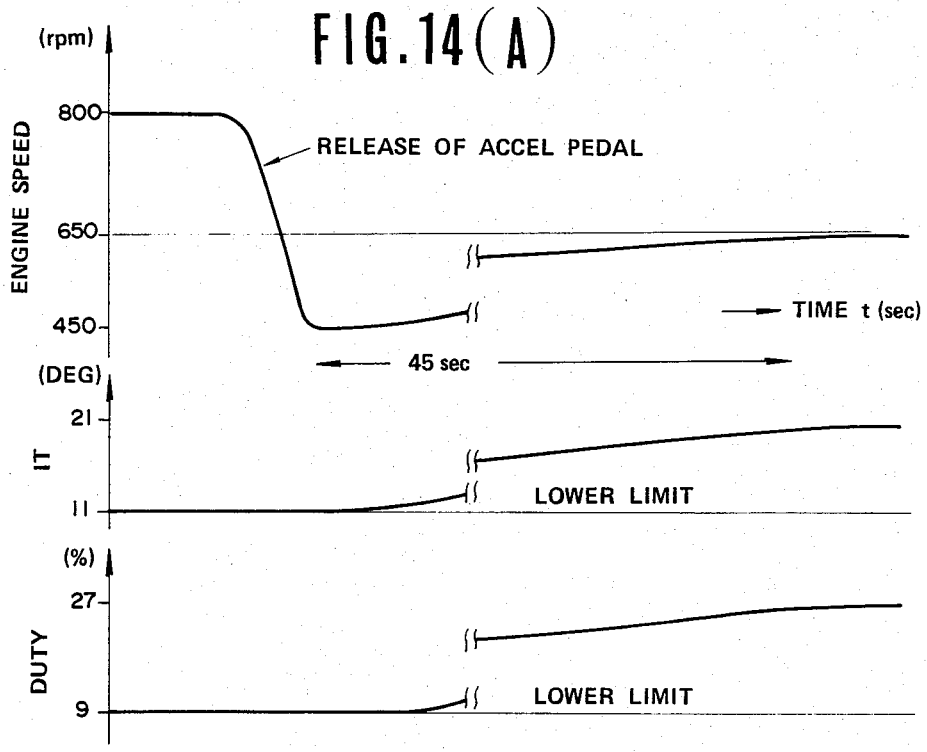
FIG. 14(A) is graphical representations showing an experimental result of engine idle speed variation, ignition timing and duty factor obtained by a method of controlling engine idle speed on the basis of mathematical dynamic models when an uncontrollable air disturbance (accelerator pedal) is applied to or removed from the engine.

FIG. 14(A) shows another experimental result of the engine speed, ignition timing and duty factor obtained when another uncontrollable air disturbance is applied to and next removed from the engine. To explain the abovementioned danger of engine stop with reference to FIG. 14(A), when the vehicle stops, if the driver depresses the accelerator pedal slightly to such a degree that the throttle valve is kept opened a little and the throttle valve switch is kept closed, the engine is kept at a higher speed. Therefore, the ignition timing is set to the lower limit of 11 degrees and the duty factor is also set to the lower limit of 9 percent. Under these conditions, when the driver releases the accelerator pedal suddenly, since the quantity of air supplied through the throttle valve decreases suddenly, the engine speed drops suddenly far below the target value of 650 rpm, and the control system begins to operate to increase the engine speed, that is, to increase the spark advance rate and the duty factor. However, if the engine speed is kept at a higher value for a long time, since a great integral value DUN of the speed difference SA between the target value $N_r$ and the actual value N is stored in the microcomputer, it takes a great amount time to eliminate the influence of the stored integral, thus causing engine stop.

Figure 14B:
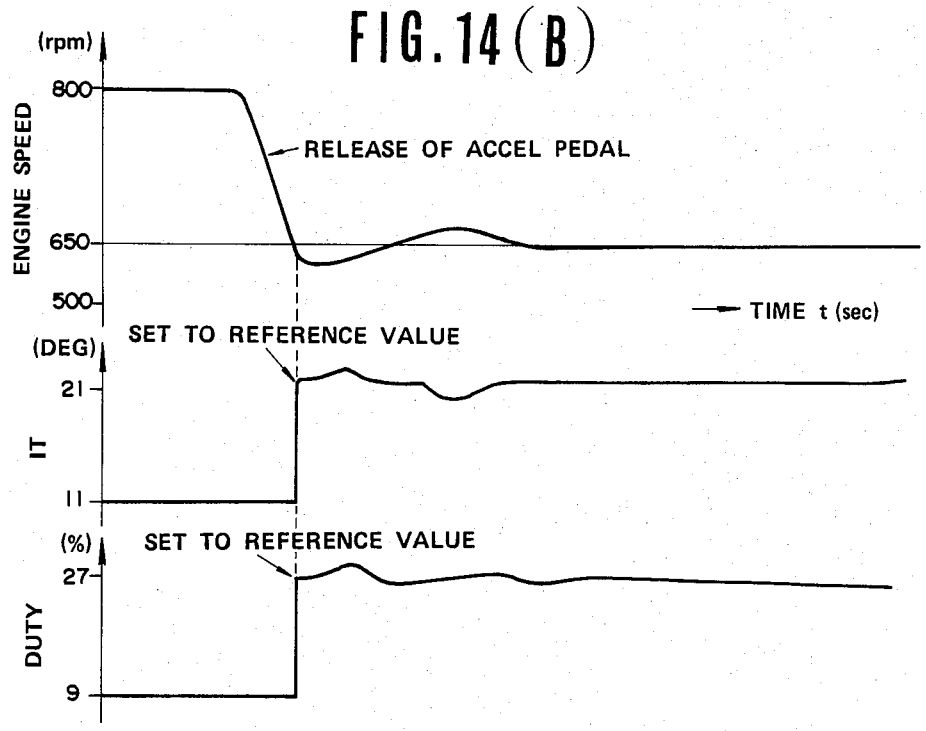
FIG. 14(B) is graphical representations showing an experimental result of engine idle speed variation, ignition timing and duty factor obtained by the method of controlling engine idle speed on the basis of mathematical dynamic models according to the present invention when the ignition timing and the duty factor are once cancelled and set to the predetermined refrence values after uncontrollable air disturbance (accelerator pedal) is removed from the engine.

FIG. 14(B) shows an experimental result of engine speed, ignition timing and duty factor obtained when the ignition timing and the duty factor are once cancelled and set to the predetermined reference values (timing is 21 degrees, duty is 27 percent) after uncontrollable air disturbance is removed from the engine and when the engine speed reaches the target value $N_r$. This drawing indicates that the engine speed can be controlled to the target value quickly even after the external disturbance is removed suddenly.

The sixth feature of the present invention is to calculate the target engine idle speed $N_r$ appropriate to coolant temperature, the on-or-off state of the air conditioning system, connection-or-disconnection state of the power steering pump, the magnitude of battery voltage, etc.

Figure 15:
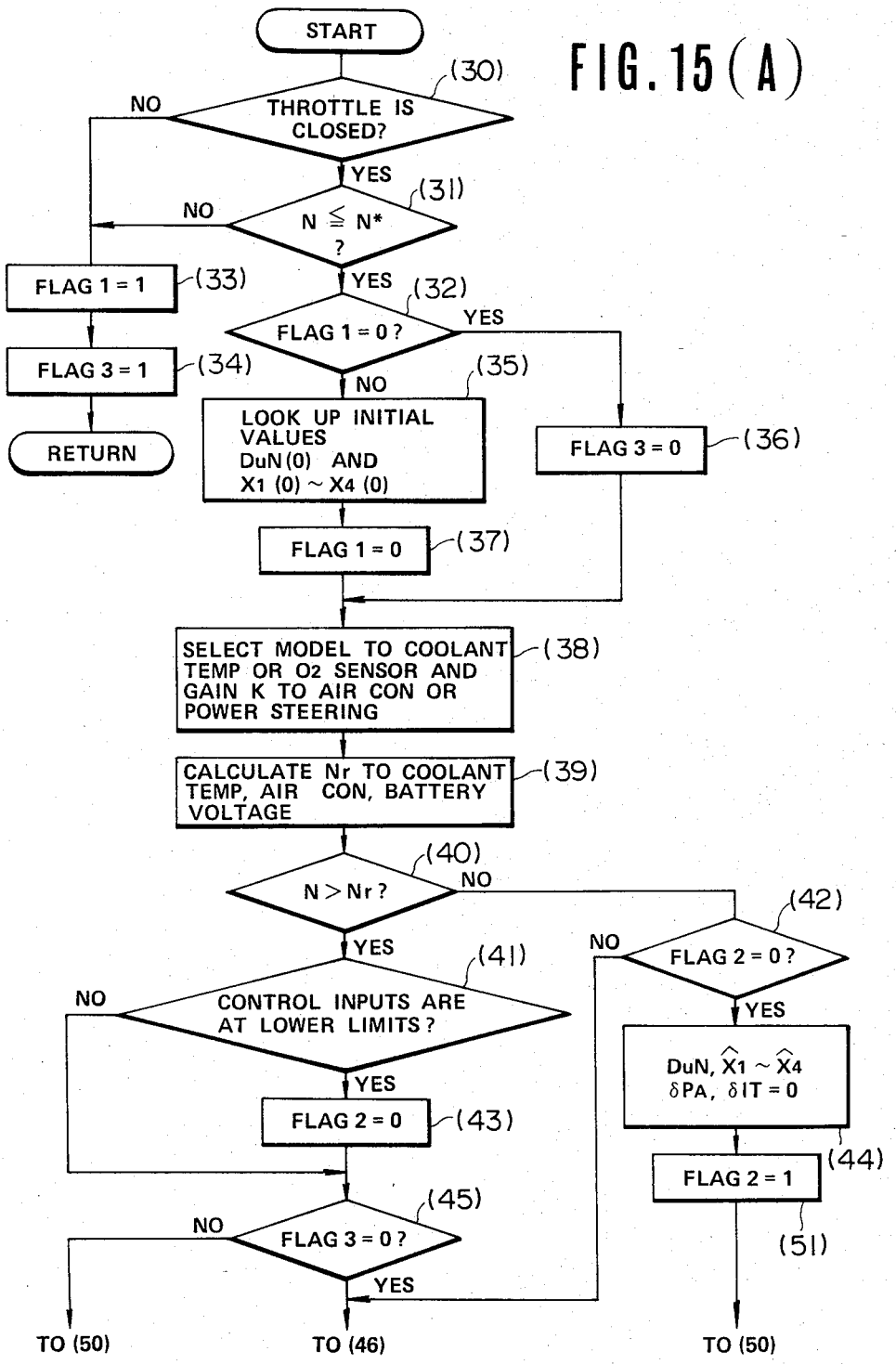
FIGS. 15A and 15B are a flowchart of assistance in explaining the method of feedback controlling engine idle speed to a target speed according to the present invention.
Figure 15B:
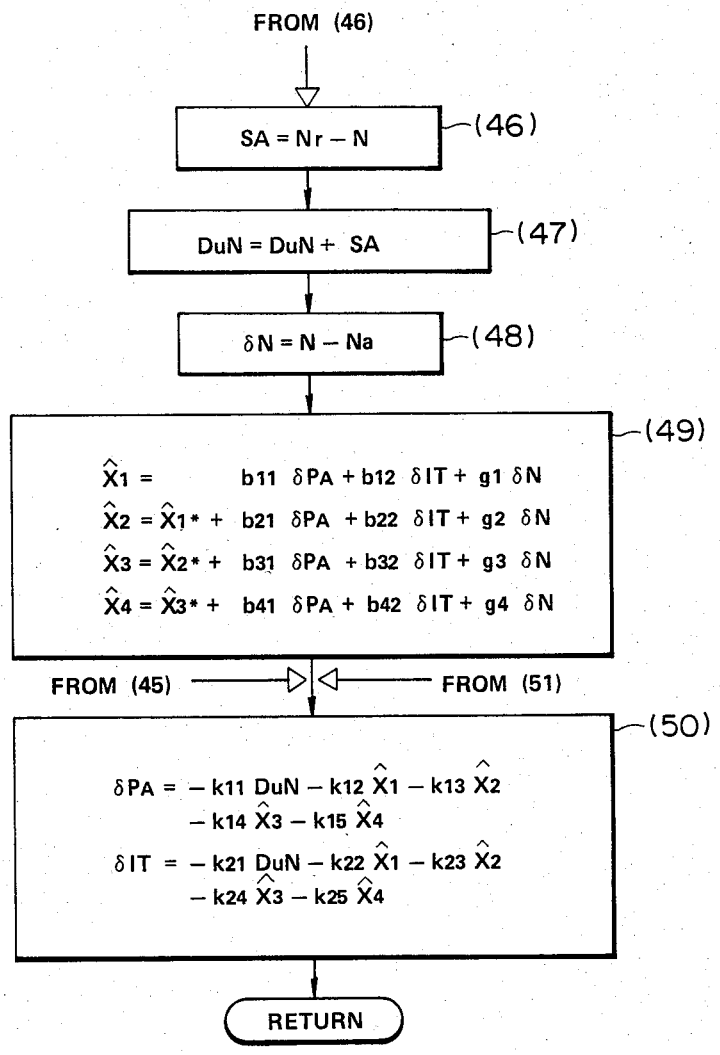

With reference to the flowchart shown in FIG. 15, the method of feedback controlling engine idle speed to a target value according to the present invention will be described hereinbelow. When the control program starts, control first checks whether the throttle valve is fully closed or not in response to a signal from a throttle valve switch (in block 30). If the throttle valve is fully closed, control checks whether the current engine speed N is equal to or lower than a predetermined idle speed N* (e.g. 1100 rpm) at which idle speed control starts (in block 31). If the throttle valve is not fully closed or the current engine speed N exceeds the predetermined value N*, FLAG 1 is set to "1" (in block 33) and FLAG 3 is also set to "1" (in block 34), returning to the START. If the throttle valve is fully closed and further the current speed N is equal to or lower than the predetermined control start speed N*, control determines whether idle speed control must be carried out by checking that FLAG 1 is not at "0", that is, FLAG 1 is at "1" (in block 32), because this FLAG 1=1 indicates that engine speed is first controlled. Therefore, if FLAG 1 is "1", control determines the initial integral value DUN(0) according to the difference between the idle speed N obtained when the throttle valve is fully closed and the idle speed N* at which idle speed control starts and the initial state variables $x_1(0)$, $x_2(0)$, $x_3(0)$, and $x_4(0)$ on the basis of a two dimensional look-up table stored in the microcomputer under the consideration of two idle speeds N and N* (in block 35).

Thereafter, control sets FLAG 1 to "0" indicating that the initial values have already been determined (in block 37). Further, if FLAG 1 is "0" (in block 32), control determines that the initial values have already been determined and sets FLAG 3 to "0" to indicate that idle speed control has started (in block 36). Next, control selects an appropriate mathematical model indicative of engine internal dynamic behavior corresponding to the current coolant temperature $T_w$ or oxygen sensor state (activated or deactivated) and an appropriate gain K corresponding to the air conditioning system state (turned on or off) or the power steering pump state (connected to or disconnected from the engine) in response to signals from the air conditioning system or the pump (in block 38). The gains K are predetermined and stored in the microcomputer according to the air conditioning system and the steering pump. The control calculates an appropriate target engine idle speed $N_r$ on the basis of coolant temperature $T_w$, air conditioning system state or battery voltage (in block 39).

The blocks 40 to 45 shows the steps of detecting whether an uncontrollable external disturbance is applied to the engine and of preventing the occurrence of engine stop after the disturbance is removed suddenly from the engine. Control first checks whether the current engine speed N exceeds the calculated target engine speed $N_r$ (in block 40) and then checks whether the controlling input values are fixed at the lower limits (in block 41). If N exceeds $N_r$ and the input values are fixed at the lower limits, control sets FLAG 2 to "0" to indicate an abnormal state (in block 43). Thereafter, if FLAG 3 is at "0" (in block 45), since this indicates that control has started, control advances to block 46 for calculating the idle speed controlling input signals $\delta P_A$ and $\delta IT$ as described later. If FLAG 3 is not at "0", that is, at "1" (in block 45), since this indicates that control has not started, control advances directly to block 50 for directly calculating the initial controlling input signals $\delta P_A$ and $\delta IT$ on the basis of the initial values DUN(0), $x_1(0)-x_4(0)$ looked up in block 35, without calculating the integral DUN of speed difference SA and without estimating the state variables $x_1$, $x_2$, $x_3$ and $x_4$.

When the external disturbance is removed from the engine and therefore the current engine speed N drops below the calculated target speed $N_r$ (in block 40), after having confirmed that FLAG 2 is at "0" (this indicates that an abnormal state occurs once) (in block 42), control cancels all the current values of integral DUN, estimated state variables $x_1-x_4$, controlling input signals $\delta P_A$, $\delta IT$ (in block 44). FLAG 2 is set to "1" to cancel the occurrence of the abnormal state (in block 51). Thereafter control advances to block 50 in order to calculate the reference controlling inputs $\delta P_A$, $\delta IT$ on the basis of predetermined reference values.

If the controlling inputs are not fixed at the lower limits (in block 41), since this indicates no abnormal external disturbance, control advance to block 46 after confirming that FLAG 3 is "0" (this indicates that control has started), without setting FLAG 2 to "0".

When idle speed N exceeds the target speed $N_r$ (in block 40), when controlling input signals are not fixed at the lower limits (in block 41), and when FLAG 3 is "0" (this indicates control start)(in block 45), control advances to the succeeding calculations shown in blocks from 46 to 50. That is, control calculates the current speed difference SA between the target speed $N_r$ and the detected speed N (in block 46) and integrates the difference SA by the use of DUN(0) (in block 47) and calculates a speed perturbation $\delta N$ between the current speed N the reference speed $N_a$ designed in accordance with a linearly-approximated transfer function matrix (in block 48). Further, control estimates state variables $\hat{x}_1$, $\hat{x}_2$, $\hat{x}_3$ and $\hat{x}_4$ on the basis of calculated perturbation $\delta N$ and controlling inputs $\delta P_A$, $\delta IT$ previously calculated in block 50 (in block 49). Here, $\hat{x}_1$*, $\hat{x}_2$* and $\hat{x}_3$* designate the preceding estimated values; $b_{ij}$ and $g_j$ designate constant values stored in the microcomputer. Finally, control calculates the increments of controlling input signals such as duty factor $\delta P_A$ of the signals applied to the control solenoid to adjust the bypass air flow rate and ignition timing $\delta IT$ (spark advance rate) deviating from the predetermined reference values designed in a linearly-approximated transfer function matrix, on the basis of the already estimated state variables $\hat{x}_1$, $\hat{x}_2$, $\hat{x}_3$ and $\hat{x}_4$, speed difference integral DUN and the most appropriate gain K (elements are shown as $k_{ij}$)(in block 50).

Further, in block 45, if FLAG 3 is "1", since this indicates that idle speed control has not yet started, the control advances to block 50 directly, without estimating the state variables $\hat{x}_1$, $\hat{x}_2$, $\hat{x}_3$ and $\hat{x}_4$. In block 50, the initial controlling inputs $\delta P_A$, $\delta IT$ are calculated on the basis of the initial values looked up in block 35. Furthermore, in block 49, the expressions show an example of finite constant coefficient observer, the (A-GC) of which can be given in expression (6) as $$A - GC = \begin{vmatrix} 0 & 0 & 0 & 0 \\ 1 & 0 & 0 & 0 \\ 0 & 1 & 0 & 0 \\ 0 & 0 & 1 & 0 \end{vmatrix}$$

Comparison of controllability of the method according to the present invention with that of the conventional (proportional/integral) method will be described hereinbelow.

Figure 16:
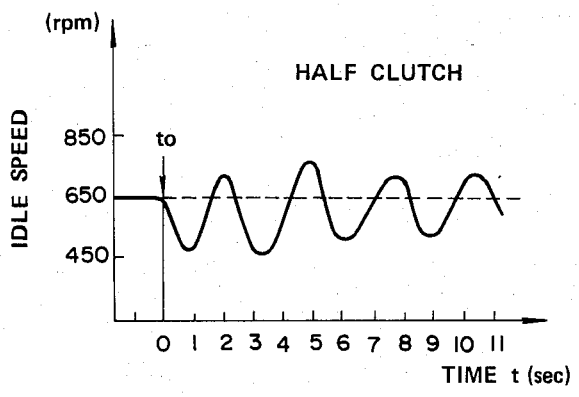
FIG. 16 (A) (PRIOR ART)
FIG. 16(A) is a graphical representation showing an experimental result of engine idle speed variation obtained by a prior art proportion/integration control method in the transient state where load is connected to the engine with the clutch half depressed or engaged.
FIG. 16(B) is a graphical representation showing an experimental result of engine idle speed variation obtained by the method of controlling engine idle speed on the basis of mathematical dynamic models according to the present invention in the same transient state as in FIG. 16(A)
Figure 16:
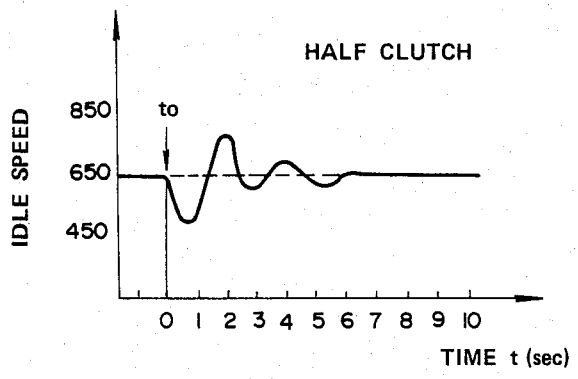

FIG. 16(A) shows an experimental result of engine idle speed variation obtained by the conventional method in the transient state where load is connected to the engine with the clutch half depressed or engaged. At point $t_0$, the clutch is half engaged while depressing the brake pedal. This drawing indicates that it is difficult to control engine idle speed to a target value of 650 rpm.

FIG. 16(B) shows an experimental result of engine idle speed variation obtained by the multivariable control method according to the present invention in the same transient state as in FIG. 16(A). This drawing indicates that the engine idle speed can be controlled to a target value of 650 rpm during a relatively short time period (several seconds).

Figure 17A:
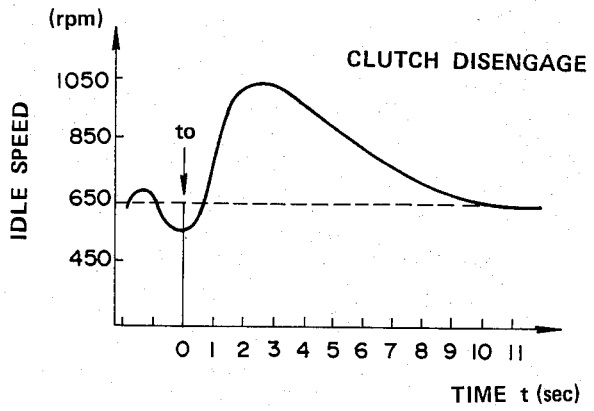
FIG. 17(A) (PRIOR ART)
FIG. 17(A) is a graphical representation showing an experimental result of engine idle speed variation obtained by a prior art proportion/integration control method in the transient state where load is disconnected from the engine with the clutch disengaged.

FIG. 17(A) shows an experimental result of engine idle speed variation obtained by the conventional method in the transient state where load is disconnected from the engine with the clutch disengaged at point $t_0$. This drawing indicates that the engine speed increases after load has been disconnected fron the engine and then decreases to the target value of 650 rpm after a relatively long time period of several seconds.

Figure 17B:
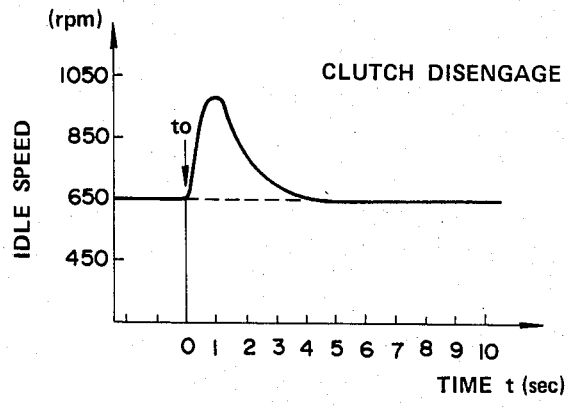
FIG. 17(B) is a grphical representation showing an experimental result of engine idle speed variation obtained by the method of controlling engine idle speed on the basis of mathematical dynamic models according to the present invention in the same transient state as in FIG. 17(A)

FIG. 17(B) shows an experimental result of engine idle speed variation obtained by the multivariable control method according to the present invention in the same transient state as in FIG. 17(A). This drawing indicates that the engine speed increases after load has been disconnected from the engine but decreases to the target value within a relatively short time period of a few seconds.

Figure 18A:
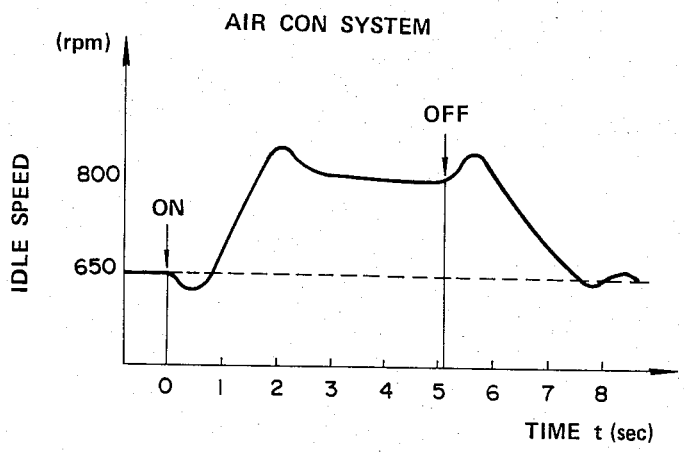
FIG. 18(A) (PRIOR ART)
FIG. 18(A) is a graphical representation showing an experimental result of engine idle speed variation obtained by a prior art proportion/integration control method in the transient state where an air conditioning system is turned on with the target idle engine speed set to 800 rpm and thereafter turned off with the target idle engine speed set to 650 rpm.

FIG. 18(A) shows an experimental result of engine idle speed variation obtained by the conventional method in the transient state where an air conditioning system is connected to the engine with the target idle engine speed set to 800 rpm and then disconnected from the engine with the target speed set to 650 rpm again. This drawing indicates that the engine speed decreases when the air conditioning system is connected to the engine and increases when the system is disconnected from the engine at a speed of 800 rpm.

Figure 18B:
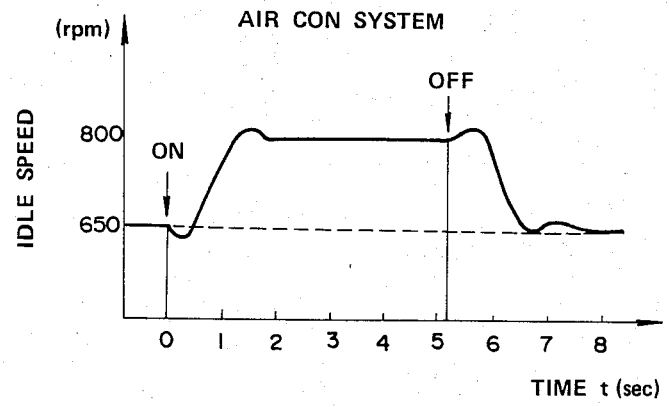
FIG. 18(B) is a graphical representation showing an experimental result of engine idle speed variation obtained by the method of controlling engine idle speed on the basis of mathematical dynamic models according to the present invention in the same transient state as in FIG. 18(A)

FIG. 18(B) shows an experimental result of engine idle speed variation obtained by the multivariable control method according to the present invention in the same transient state as in FIG. 18(A). This drawing indicates that although the engine speed increases or decreases in the same way, the variation is not so great as in FIG. 18(A).

Figure 19A:
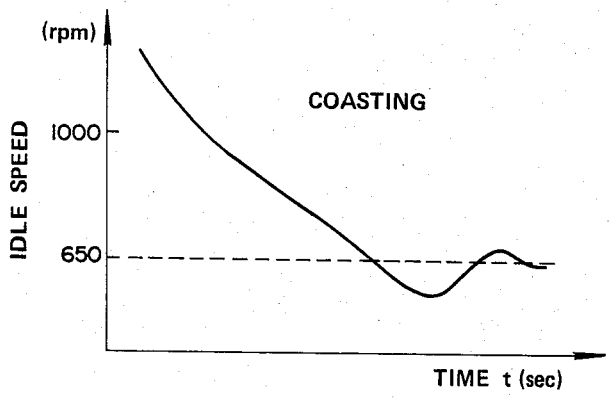
FIG.19(A) (PRIOR ART)
FIG. 19(A) is a graphical representation showing an experimental result of engine idle speed variation obtained by a prior art proportion/integration control method in the transient state were the engine is allowed to coast from an unload high engine speed to a target value of 650 rpm.

FIG. 19(A) shows an experimental result of engine idle speed variation obtained by the conventional method in the transient state where the engine is allowed to coast from an unload high engine speed to a target value of 650 rpm. This drawing indicates that a relatively great hunting occurs when the speed reaches 650 rpm.

Figure 19B:
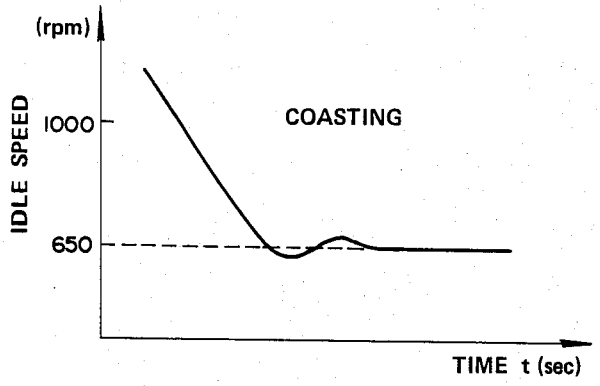
FIG. 19(B) is a graphical representation showing an experimental result of engine idle speed variation obtained by the method of controlling engine idle speed on the basis of mathematical dynamic models according to the present invention, in the same transient state as in FIG. 19(A).

FIG. 19(B) shows an experimental result of engine idle speed variation obtained by the multivariable control method according to the present invention in the same transient state as in FIG. 19(A). This drawing indicates that a relatively small hunting occurs when the engine reaches 650 rpm.

These figures from 16(A) to 19(B) indicate that the controllability in various transient states is markedly improved in the multivariable control method according to the present invention, as compared with that in the conventional control method.

The method of controlling engine idle speed according to the present invention has been described only in the case where the pulse width (duty factor $P_A$) of a signal applied to a control solenoid for controlling the air bypassing the throttle valve and the ignition timing (spark advance rate IT) are adopted as the controlling input parameters. However, without being limited to these parameters, it is possible to adopt at least one or two or more combinations of air quantity or equivalent thereto, ignition timing, fuel quantity or equivalent thereto and EGR quantity or equivalent thereto.

As described above, in the method of feedback controlling engine idle speed to a target value according to the present invention (1) a multivariable control method is adopted on the basis of engine internal dynamic models, (2) dynamic state can be estimated, (3) the mathematical order of the dynamic models is relatively low ($n=4$), (4) the resulting approximating error is absorbed by integration steps, (5) the dynamic models are appropriately selected according to the engine dynamic behavior, (6) initial values of variables and speed difference integral are given when engine idle speed control starts; in various transient states, it is possible to prevent engine idle speed from dropping below the target value, to improve control response characteristic against misfire or load disturbance and thus to control engine idle speed stably.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A method of feedback controlling engine idle speed to a target speed on the basis of mathematical dynamic models to determine engine state variables representative of engine dynamic behavior, which comprises the following step of:

(a) calculating the differences SA between the target engine idle speed $N_r$ and current engine speeds N;

(b) integrating the calculated idle speed differences SA to obtain integral value DUN of speed differences;

(c) selecting an appropriate mathematical engine dynamic model according to at least one of predetermined engine operating conditions;

(d) estimating low-order variables $\hat{x}_i$ representative of engine internal dynamic states in accordance with the selected dynamic model and on the basis of at least one or two or more combinations of preceding increments of engine idle speed controlling parameters $\delta P_A$, $\delta IT$ and controlled engine idle speed $\delta N$;

(e) selecting an appropriate gain K according to external engine load conditions; and (f) determining increments of engine idle speed controlling parameters $\delta P_A$, $\delta IT$ on the basis of the estimated state variables $\hat{x}_i$, the selected gain K, and the integrated idle speed difference DUN, whereby engine idle speed is feedback controlled in accordance with low-order engine dynamic state variables.

2. A method of feedback controlling engine idle speed as set forth in claim 1, wherein the order of said low-order state variables $\hat{x}_i$ estimated in step (d) is four of $\hat{x}_1$, $\hat{x}_2$, $\hat{x}_3$ and $\hat{x}_4$.

3. A method of feedback controlling engine idle speed as set forth in claim 1, wherein in the step (b), the initial integral value DUN(0) is determined on the basis of an engine speed N detected when a throttle valve is fully closed and a predetermined engine speed N* at which idle speed control starts, in two dimensional table look-up method, when idle speed control starts.

4. A method of feedback controlling engine idle speed as set forth in claim 3, wherein when the actual engine speed N drops below the predetermined engine speed N* with the throttle valve fully closed so that idle speed control start is determined, the engine speed N is set to a pseudo engine speed N' near to or below a target engine idle speed $N_r$ in order to reduce the absolute value of the initial integral value DUN(0) and thereby to prevent the idle speed from being controlled excessively into undershooting.

5. A method of feedback controlling engine idle speed as set forth in claim 1, wherein in the step (d), initial engine dynamic state variables $\hat{x}_i(0)$ are determined on the basis of an engine idle speed N detected when a throttle valve is fully closed and a predetermined engine speed N* at which idle speed control starts, in two dimensional table look-up method, when idle speed control starts.

6. A method of feedback controlling engine idle speed as set forth in claim 1, wherein in the step (c), at least one of said predetermined engine operating conditions is lean-rich condition in engine exhaust gas detected by an oxygen sensor.

7. A method of feedback controlling engine idle speed as set forth in claim 1, wherein in the step (c), at least one of said predetermined engine operating conditions is coolant temperature detected by a coolant temperature sensor.

8. A method of feedback controlling engine idle speed as set forth in claim 1, wherein in the step (d), said idle speed controlling parameters are quantity of air supplied to the engine, ignition timing, quantity of fuel supplied to the engine and the quantity of exhaust gas recirculated into the engine or these equivalent valves.

9. A method of feedback controlling engine idle speed as set forth in claim 1, wherein in the step (e), the appropriate gain K is selected depending upon whether an air conditioning system is connected to or disconnected from the engine to be controlled.

10. A method of feedback controlling engine idle speed as set forth in claim 1, wherein in the step (e), the appropriate gain K is selected depending upon whether a power steering pump is connected to or disconnected from the engine to be controlled.

11. A method of feedback controlling engine idle speed as set forth in claim 1, wherein the target engine idle speed $N_r$ is adjusted according to engine coolant temperature.

12. A method of feedback controlling engine idle speed as set forth in claim 1, wherein the target engine idle speed $N_r$ is adjusted according to battery terminal voltage.

13. A method of feedback controlling engine idle speed as set forth in claim 1, wherein the target engine speed $N_r$ is adjusted according to whether an air conditioning system is connected to or disconnected from the engine to be controlled.

14. A method of feedback controlling engine idle speed as set forth in claim 1, wherein the target engine idle speed $N_r$ is adjusted according to whether a power steering pump is connected to or disconnected from the engine to be controlled.

15. A method of feedback controlling engine idle speed as set forth in claim 1, which further comprises the following steps of cancelling all the values of integral DUN of idle speed difference SA, estimated state variables $\hat{x}_i$ and determined increments of idle speed controlling parameters $\delta P_A$, $\delta IT$ and setting all the cancelled values to reference values, respectively, when engine idle speed N drops to the target value $N_r$ suddenly after engine idle speed N has been kept at a value higher than the predetermined target value $N_r$ and the idle speed controlling parameters have been kept at the respective lower limits.

16. A method of feedback controlling engine idle speed as set forth in claim 1, which further comprises the steps of forward controlling engine idle speed by increasing the increments of idle speed controlling input when a detectable load is connected to an engine to be controlled and by decreasing the increased increments to the original level when the load is disconnected from the engine.

17. A method of feedback controlling engine idle speed as set forth in claim 16, wherein the detected load is an air conditioning system.

18. A method of feedback controlling engine idle speed as set forth in claim 16, wherein the detectable load is a power steering pump.

19. A method of feedback controlling engine idle speed to a target speed on the basis of mathematical dynamic models to determine engine state variables representative of engine dynamic behavior, which comprises the following steps of:

(a) detecting an engine speed when a throttle valve is fully closed;

(b) detecting that engine idle speed N drops below a predetermined idle speed N* at which engine idle speed control starts;

(c) if the throttle valve is fully closed and further the engine idle speed N drops below a predetermined control start value N*, determining an initial value DUN(0) of integral DUN of speed difference SA between target engine speed value $N_r$ and detected engine speed value N, and initial values $\hat{x}_1(0)$ to $\hat{x}_4(0)$ of engine dynamic state variables in two dimensional table look-up method, when idle speed control starts;

(d) selecting an appropriate engine internal dynamic model according to engine operating conditions, and an appropriate control gain K according to engine load conditions;

(e) calculating an appropriate target engine idle speed $N_r$ according to engine operating conditions;

(f) detecting that engine speed N exceeds the calculated target value $N_r$ and idle speed controlling values $\delta P_A$, $\delta IT$ are fixed at lower limits;

(g) if engine speed N drops below the target value $N_r$ from the state where engine speed N exceeds the calculated target value $N_r$ and the idle speed controlling values are fixed at the lower limits, cancelling all the values of integral DUN, estimated variables $\hat{x}_1$ to $\hat{x}_4$, and calculated increments of speed controlling parameters $\delta P_A$, $\delta IT$ and setting all the cancelled values to reference values, respectively;

(h) if engine speed N does not drop below the target value N and the idle speed controlling values are not fixed at the lower limits, calculating difference SA between the target engine speed value $N_r$ and the detected engine speed N;

(i) integrating the difference SA to obtain DUN by the use of the determined initial value DUN(0);

(j) calculating engine speed perturbation $\delta N$ from designed reference engine speed value Na;

(k) estimating state variables $\hat{x}_1$ to $\hat{x}_4$ in accordance with the selected engine dynamic model and on the basis of the preceding estimated state variables $\hat{x}_1$* to $\hat{x}_4$*, the calculated engine speed perturbation $\delta N$; and the preceding engine speed controlling values $\delta P_A$, $\delta IT$; and (1) calculating increments of engine controlling values $\delta P_A$, $\delta IT$ on the basis of estimated state variables $\hat{x}_1$ to $\hat{x}_4$, the calculated speed difference integral DUN and the selected gain K.

* * * * *